US007730965B2

(12) United States Patent
Jordan et al.

(10) Patent No.: US 7,730,965 B2
(45) **Date of Patent: *Jun. 8, 2010**

(54) RETRACTABLE JOINT AND CEMENTING SHOE FOR USE IN COMPLETING A WELLBORE

(75) Inventors: John Christopher Jordan, Spring, TX (US); James G. Martens, Spring, TX (US); R. Lee Colvard, Tomball, TX (US); Brent J. Lirette, Cypress, TX (US); Gregory Guy Galloway, Conroe, TX (US); David J. Brunnert, Cypress, TX (US); Gregory Gerard Gaspard, Terrytown, LA (US); John Robert Gradishar, Houston, TX (US)

(73) Assignees: Weatherford/Lamb, Inc., Houston, TX (US); Shell Oil Company, Houston, TX (US)

( * ) Notice: Subject to any disclaimer, the term of this patent is extended or adjusted under 35 U.S.C. 154(b) by 395 days.

This patent is subject to a terminal disclaimer.

(21) Appl. No.: 11/343,148

(22) Filed: Jan. 30, 2006

(65) Prior Publication Data

US 2006/0185855 A1 Aug. 24, 2006

Related U.S. Application Data

(63) Continuation-in-part of application No. 11/140,858, filed on May 31, 2005, now Pat. No. 7,083,005, which is a continuation of application No. 10/319,792, filed on Dec. 13, 2002, now Pat. No. 6,899,186.

(60) Provisional application No. 60/683,070, filed on May 20, 2005.

(51) Int. Cl.
*E21B 7/08* (2006.01)

(52) U.S. Cl. ..... 175/5; 175/6; 175/171; 166/358

(58) Field of Classification Search ..... 175/171, 175/5, 7, 8; 166/358, 242.7, 290
See application file for complete search history.

(56) References Cited

U.S. PATENT DOCUMENTS 122,514 A 1/1872 Bullock (Continued)

FOREIGN PATENT DOCUMENTS

CA 2 307 386 11/2000

(Continued)

OTHER PUBLICATIONS

Charles O. Vail and Verne Smith, New Developments in Air-Gas Drilling and Completions, World Oil, Part One, Nov. 1963, pp. 70-73.

(Continued)

*Primary Examiner*—William P Neuder
(74) *Attorney, Agent, or Firm*—Patterson & Sheridan, L.L.P.

(57) ABSTRACT

An improved method and/or apparatus for completing a wellbore is provided. In one embodiment, a method of lining a pre-drilled wellbore is provided. The method includes the act of providing a casing assembly, the casing assembly including a string of casing; and a retractable joint comprising an inner tubular and an outer tubular. The method further includes the acts of running the casing assembly into the pre-drilled wellbore and actuating the retractable joint, thereby reducing the length of the casing assembly through movement between the inner and outer tubulars.

61 Claims, 14 Drawing Sheets

U.S. PATENT DOCUMENTS

| | | | | |
|---|---|---|---|---|
| 761,518 | A | | 5/1904 | Lykken |
| 1,077,772 | A | | 11/1913 | Weathersby |
| 1,185,582 | A | | 5/1916 | Bignell |
| 1,301,285 | A | | 4/1919 | Leonard |
| 1,324,303 | A | | 12/1919 | Carmichael |
| 1,342,424 | A | | 6/1920 | Cotten |
| 1,459,990 | A | | 6/1923 | Reed |
| 1,471,526 | A | | 10/1923 | Pickin |
| 1,545,039 | A | | 7/1925 | Deavers |
| 1,561,418 | A | | 11/1925 | Duda |
| 1,569,729 | A | | 1/1926 | Duda |
| 1,597,212 | A | | 8/1926 | Spengler |
| 1,830,625 | A | | 11/1931 | Schrock |
| 1,851,289 | A | | 3/1932 | Owen |
| 1,880,218 | A | | 10/1932 | Simmons |
| 1,930,825 | A | | 10/1933 | Raymond |
| 1,981,525 | A | | 11/1934 | Price |
| 1,998,833 | A | | 4/1935 | Crowell |
| 2,017,451 | A | | 10/1935 | Wickersham |
| 2,049,450 | A | | 8/1936 | Johnson |
| 2,060,352 | A | | 11/1936 | Stokes |
| 2,102,555 | A | | 12/1937 | Dyer |
| 2,184,681 | A | | 12/1939 | Osmun et al. |
| 2,214,226 | A | | 9/1940 | English |
| 2,216,226 | A | | 10/1940 | Bumpous |
| 2,216,895 | A | | 10/1940 | Stokes |
| 2,228,503 | A | | 1/1941 | Boyd et al. |
| 2,295,803 | A | | 9/1942 | O'Leary |
| 2,305,062 | A | | 12/1942 | Church et al. |
| 2,324,679 | A | | 7/1943 | Cox |
| 2,344,120 | A | | 3/1944 | Baker |
| 2,345,308 | A | | 3/1944 | Wallace |
| 2,370,832 | A | | 3/1945 | Baker |
| 2,379,800 | A | | 7/1945 | Hare |
| 2,383,214 | A | | 8/1945 | Prout |
| 2,499,630 | A | | 3/1950 | Clark |
| 2,570,080 | A | | 10/1951 | Stone |
| 2,621,742 | A | | 12/1952 | Brown |
| 2,627,891 | A | | 2/1953 | Clark |
| 2,650,314 | A | | 8/1953 | Hennigh et al. |
| 2,663,073 | A | | 12/1953 | Bieber et al. |
| 2,696,367 | A | | 12/1954 | Robishaw |
| 2,720,267 | A | | 10/1955 | Brown |
| 2,738,011 | A | | 3/1956 | Mabry |
| 2,741,907 | A | | 4/1956 | Genender et al. |
| 2,743,087 | A | | 4/1956 | Layne et al. |
| 2,743,495 | A | | 5/1956 | Eklund |
| 2,764,329 | A | | 9/1956 | Hampton |
| 2,765,146 | A | | 10/1956 | Williams |
| 2,805,043 | A | | 9/1957 | Williams |
| 2,836,247 | A | * | 5/1958 | Mcculloch ..... 166/290 |
| 2,898,971 | A | | 8/1959 | Hempel |
| 2,978,047 | A | | 4/1961 | DeVaan |
| 3,001,585 | A | | 9/1961 | Shiplet |
| 3,006,415 | A | | 10/1961 | Burns et al. |
| 3,054,100 | A | | 9/1962 | Jones |
| 3,087,546 | A | | 4/1963 | Woolley |
| 3,090,031 | A | | 5/1963 | Lord |
| 3,102,599 | A | | 9/1963 | Hillburn |
| 3,111,179 | A | | 11/1963 | Albers et al. |
| 3,117,636 | A | | 1/1964 | Wilcox et al. |
| 3,123,160 | A | | 3/1964 | Kammerer |
| 3,124,023 | A | | 3/1964 | Marquis et al. |
| 3,131,769 | A | | 5/1964 | Rochemont |
| 3,159,219 | A | | 12/1964 | Scott |
| 3,169,592 | A | | 2/1965 | Kammerer |
| 3,191,677 | A | | 6/1965 | Kinley |
| 3,191,680 | A | | 6/1965 | Vincent |
| 3,195,646 | A | | 7/1965 | Brown |
| 3,266,582 | A | | 8/1966 | Homanick |
| 3,273,660 | A | | 9/1966 | Jackson et al. |
| 3,353,599 | A | | 11/1967 | Swift |
| 3,387,893 | A | | 6/1968 | Hoever |
| 3,419,079 | A | | 12/1968 | Current |
| 3,467,180 | A | | 9/1969 | Pensotti |
| 3,550,684 | A | | 12/1970 | Cubberly, Jr. |
| 3,552,848 | A | | 1/1971 | Van Wagner |
| 3,559,739 | A | | 2/1971 | Hutchison |
| 3,575,245 | A | | 4/1971 | Cordary et al. |
| 3,603,411 | A | | 9/1971 | Link |
| 3,603,412 | A | | 9/1971 | Kammerer, Jr. et al. |
| 3,603,413 | A | | 9/1971 | Grill et al. |
| 3,621,910 | A | | 11/1971 | Sanford |
| 3,624,760 | A | | 11/1971 | Bodine |
| 3,638,989 | A | | 2/1972 | Sandquist |
| 3,656,564 | A | | 4/1972 | Brown |
| 3,669,190 | A | | 6/1972 | Sizer et al. |
| 3,691,624 | A | | 9/1972 | Kinley |
| 3,692,126 | A | | 9/1972 | Rushing et al. |
| 3,696,332 | A | | 10/1972 | Dickson, Jr. et al. |
| 3,712,376 | A | | 1/1973 | Owen et al. |
| 3,729,057 | A | | 4/1973 | Werner |
| 3,760,894 | A | | 9/1973 | Pitifer |
| 3,776,307 | A | | 12/1973 | Young |
| 3,785,193 | A | | 1/1974 | Kinley et al. |
| 3,818,734 | A | | 6/1974 | Bateman |
| 3,870,114 | A | | 3/1975 | Pulk et al. |
| 3,871,618 | A | | 3/1975 | Funk |
| 3,911,707 | A | | 10/1975 | Minakov et al. |
| 3,934,660 | A | | 1/1976 | Nelson |
| 3,935,910 | A | | 2/1976 | Gaudy et al. |
| 3,945,444 | A | | 3/1976 | Knudson |
| 3,947,009 | A | | 3/1976 | Nelmark |
| 3,948,321 | A | | 4/1976 | Owen et al. |
| 3,964,552 | A | | 6/1976 | Slator |
| 3,964,556 | A | | 6/1976 | Gearhart et al. |
| 4,049,066 | A | | 9/1977 | Richey |
| 4,054,426 | A | | 10/1977 | White |
| 4,064,939 | A | | 12/1977 | Marquis |
| 4,069,573 | A | | 1/1978 | Rogers, Jr. et al. |
| 4,082,144 | A | | 4/1978 | Marquis |
| 4,083,405 | A | | 4/1978 | Shirley |
| 4,085,808 | A | | 4/1978 | Kling |
| 4,095,865 | A | | 6/1978 | Denison et al. |
| 4,100,981 | A | | 7/1978 | Chaffin |
| 4,127,168 | A | | 11/1978 | Hanson et al. |
| 4,133,396 | A | | 1/1979 | Tschirky |
| 4,159,564 | A | | 7/1979 | Cooper, Jr. |
| 4,173,457 | A | | 11/1979 | Smith |
| 4,175,619 | A | | 11/1979 | Davis |
| 4,182,423 | A | | 1/1980 | Ziebarth et al. |
| 4,186,628 | A | | 2/1980 | Bonnice |
| 4,189,185 | A | | 2/1980 | Kammerer, Jr. et al. |
| 4,194,383 | A | | 3/1980 | Huzyak |
| 4,202,225 | A | | 5/1980 | Sheldon et al. |
| 4,227,197 | A | | 10/1980 | Nimmo et al. |
| 4,241,878 | A | | 12/1980 | Underwood |
| 4,277,197 | A | | 7/1981 | Bingham |
| 4,281,722 | A | | 8/1981 | Tucker et al. |
| 4,287,949 | A | | 9/1981 | Lindsey, Jr. |
| 4,288,082 | A | | 9/1981 | Setterberg, Jr. |
| 4,311,195 | A | | 1/1982 | Mullins, II |
| 4,319,393 | A | | 3/1982 | Pogonowski |
| 4,324,407 | A | | 4/1982 | Upham et al. |
| 4,336,415 | A | | 6/1982 | Walling |
| 4,384,627 | A | | 5/1983 | Ramirez-Jauregui |
| 4,392,534 | A | | 7/1983 | Miida |
| 4,396,076 | A | | 8/1983 | Inoue |
| 4,396,077 | A | | 8/1983 | Radtke |
| 4,407,378 | A | | 10/1983 | Thomas |
| 4,408,669 | A | | 10/1983 | Wiredal |
| 4,413,682 | A | | 11/1983 | Callihan et al. |
| 4,427,063 | A | | 1/1984 | Skinner |
| 4,429,620 | A | | 2/1984 | Burkhardt et al. |

4,445,734 A 5/1984 Cunningham
4,460,053 A 7/1984 Jurgens et al.
4,463,814 A 8/1984 Horstmeyer et al.
4,466,498 A 8/1984 Bardwell
4,469,174 A 9/1984 Freeman
4,470,470 A 9/1984 Takano
4,474,243 A 10/1984 Gaines
4,483,399 A 11/1984 Colgate
4,489,793 A 12/1984 Boren
4,531,581 A 7/1985 Pringle et al.
4,544,041 A 10/1985 Rinaldi
4,545,443 A 10/1985 Wiredal
4,580,631 A 4/1986 Baugh
4,583,603 A 4/1986 Dorleans et al.
4,588,030 A 5/1986 Blizzard
4,589,495 A 5/1986 Langer et al.
4,593,584 A 6/1986 Neves
4,595,058 A 6/1986 Nations
4,605,268 A 8/1986 Meador
4,610,320 A 9/1986 Beakley
4,613,161 A 9/1986 Brisco
4,620,600 A 11/1986 Persson
4,630,691 A 12/1986 Hooper
4,651,837 A 3/1987 Mayfield
4,655,286 A 4/1987 Wood
4,671,358 A 6/1987 Lindsey, Jr. et al.
4,676,310 A 6/1987 Scherbatskoy et al.
4,678,031 A 7/1987 Blandford et al.
4,691,587 A 9/1987 Farrand et al.
4,693,316 A 9/1987 Riggenberg et al.
4,697,640 A 10/1987 Szarka
4,699,224 A 10/1987 Burton
4,708,202 A 11/1987 Sukup et al.
4,744,426 A 5/1988 Reed
4,760,882 A 8/1988 Novak
4,770,259 A 9/1988 Jansson
4,775,009 A 10/1988 Wittrisch et al.
4,778,008 A 10/1988 Gonzalez et al.
4,788,544 A 11/1988 Howard
4,806,928 A 2/1989 Veneruso
4,825,947 A 5/1989 Mikolajczyk
4,828,050 A 5/1989 Hashimoto
4,836,299 A 6/1989 Bodine
4,842,081 A 6/1989 Parant
4,848,469 A 7/1989 Baugh et al.
4,854,386 A 8/1989 Baker et al.
4,858,705 A 8/1989 Thiery
4,880,058 A 11/1989 Lindsey et al.
4,883,125 A 11/1989 Wilson et al.
4,901,069 A 2/1990 Veneruso
4,904,119 A 2/1990 Legendre et al.
4,915,181 A 4/1990 Labrosse
4,960,173 A 10/1990 Cognevich et al.
4,962,822 A 10/1990 Pascale
5,009,265 A 4/1991 Bailey et al.
5,024,273 A 6/1991 Coone et al.
5,027,914 A 7/1991 Wilson
5,052,483 A 10/1991 Hudson
5,060,737 A 10/1991 Mohn
5,069,297 A 12/1991 Krueger et al.
5,074,366 A 12/1991 Karlsson et al.
5,082,069 A 1/1992 Seiler et al.
5,083,608 A 1/1992 Abdrakhmanov et al.
5,085,273 A 2/1992 Coone
5,096,465 A 3/1992 Chen et al.
5,109,924 A 5/1992 Jurgens et al.
5,141,063 A 8/1992 Quesenbury
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky et al.
5,176,518 A 1/1993 Hordijk et al.
5,181,571 A 1/1993 Mueller
5,186,265 A 2/1993 Henson et al.
5,191,932 A 3/1993 Seefried et al.
5,197,553 A 3/1993 Leturno
5,224,540 A 7/1993 Streich et al.
5,234,052 A 8/1993 Coone et al.
5,255,741 A 10/1993 Alexander
5,271,468 A 12/1993 Streich et al.
5,271,472 A 12/1993 Leturno
5,285,008 A 2/1994 Sas-Jaworsky et al.
5,285,204 A 2/1994 Sas-Jaworsky
5,291,956 A 3/1994 Mueller et al.
5,303,772 A 4/1994 George et al.
5,305,830 A 4/1994 Wittrisch
5,311,952 A 5/1994 Eddison et al.
5,318,122 A 6/1994 Murray et al.
5,320,178 A 6/1994 Cornette
5,322,127 A 6/1994 McNair et al.
5,323,858 A 6/1994 Jones et al.
5,332,048 A 7/1994 Underwood et al.
5,343,950 A 9/1994 Hale et al.
5,343,951 A 9/1994 Cowan et al.
5,343,968 A 9/1994 Glowka
5,348,095 A 9/1994 Worrall et al.
5,353,872 A 10/1994 Wittrisch
5,355,967 A 10/1994 Mueller et al.
5,361,859 A 11/1994 Tibbitts
5,375,668 A 12/1994 Hallundbaek
5,379,835 A 1/1995 Streich
5,392,715 A 2/1995 Pelrine
5,394,823 A 3/1995 Lenze
5,402,856 A 4/1995 Warren et al.
5,409,059 A 4/1995 McHardy
5,435,386 A 7/1995 LaFleur
5,435,400 A 7/1995 Smith
5,452,923 A 9/1995 Smith
5,456,317 A 10/1995 Hood, III et al.
5,458,209 A 10/1995 Hayes et al.
5,462,120 A 10/1995 Gondouin
5,472,057 A 12/1995 Winfree
5,477,925 A 12/1995 Trahan et al.
5,494,122 A 2/1996 Larsen et al.
5,501,280 A 3/1996 Brisco
5,520,255 A 5/1996 Barr et al.
5,526,880 A 6/1996 Jordan, Jr. et al.
5,535,838 A 7/1996 Keshavan et al.
5,540,279 A 7/1996 Branch et al.
5,542,472 A 8/1996 Pringle et al.
5,542,473 A 8/1996 Pringle
5,547,029 A 8/1996 Rubbo et al.
5,551,521 A 9/1996 Vail, III
5,553,672 A 9/1996 Smith, Jr. et al.
5,553,679 A 9/1996 Thorp
5,560,426 A 10/1996 Trahan et al.
5,560,437 A 10/1996 Dickel et al.
5,560,440 A 10/1996 Tibbitts
5,566,772 A 10/1996 Coone et al.
5,582,259 A 12/1996 Barr
5,611,397 A 3/1997 Wood
5,613,567 A 3/1997 Hudson
5,615,747 A 4/1997 Vail, III
5,651,420 A 7/1997 Tibbitts et al.
5,662,170 A 9/1997 Donovan et al.
5,662,182 A 9/1997 McLeod et al.
5,667,011 A 9/1997 Gill et al.
5,667,023 A 9/1997 Harrell et al.
5,685,369 A 11/1997 Ellis et al.
5,685,373 A 11/1997 Collins et al.
5,697,442 A 12/1997 Baldridge
5,706,905 A 1/1998 Barr
5,717,334 A 2/1998 Vail, III et al.
5,718,288 A 2/1998 Bertet et al.
5,720,356 A 2/1998 Gardes 5,730,221 A 3/1998 Longbottom et al.
5,730,471 A 3/1998 Schulze-Beckinghausen et al.
5,732,776 A 3/1998 Tubel et al.
5,743,344 A 4/1998 McLeod et al.
5,755,299 A 5/1998 Langford, Jr. et al.
5,765,638 A 6/1998 Taylor
5,785,134 A 7/1998 McLeod et al.
5,787,978 A 8/1998 Carter et al.
5,791,416 A 8/1998 White et al.
5,794,703 A 8/1998 Newman et al.
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,829,539 A 11/1998 Newton et al.
5,836,409 A 11/1998 Vail, III
5,839,515 A 11/1998 Yuan et al.
5,839,519 A 11/1998 Spedale, Jr.
5,842,149 A 11/1998 Harrell et al.
5,845,722 A 12/1998 Makohl et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,540 A 4/1999 Pia et al.
5,894,897 A 4/1999 Vail, III
5,901,787 A 5/1999 Boyle
5,907,664 A 5/1999 Wang et al.
5,908,049 A 6/1999 Williams et al.
5,913,337 A 6/1999 Williams et al.
5,921,285 A 7/1999 Quigley et al.
5,921,332 A 7/1999 Spedale, Jr.
5,947,213 A 9/1999 Angle et al.
5,950,742 A 9/1999 Caraway
5,954,131 A 9/1999 Sallwasser
5,957,225 A 9/1999 Sinor
5,984,007 A 11/1999 Yuan et al.
5,988,273 A 11/1999 Monjure et al.
6,021,850 A 2/2000 Wood et al.
6,024,169 A 2/2000 Haugen
6,026,911 A 2/2000 Angle et al.
6,029,748 A 2/2000 Forsyth et al.
6,035,953 A 3/2000 Rear
6,059,051 A 5/2000 Jewkes et al.
6,059,053 A 5/2000 McLeod
6,061,000 A 5/2000 Edwards
6,062,326 A 5/2000 Strong et al.
6,070,671 A 6/2000 Cumming et al.
6,079,498 A 6/2000 Lima et al.
6,082,461 A 7/2000 Newman et al.
6,085,838 A 7/2000 Vercaemer et al.
6,089,323 A 7/2000 Newman et al.
6,098,717 A 8/2000 Bailey et al.
6,106,200 A 8/2000 Mocivnik et al.
6,135,208 A 10/2000 Gano et al.
6,155,360 A 12/2000 McLeod
6,158,531 A 12/2000 Vail, III
6,172,010 B1 1/2001 Argillier et al.
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,206,112 B1 3/2001 Dickinson, III et al.
6,216,533 B1 4/2001 Woloson et al.
6,220,117 B1 4/2001 Butcher
6,223,823 B1 5/2001 Head
6,224,112 B1 5/2001 Eriksen et al.
6,234,257 B1 5/2001 Ciglenec et al.
6,244,363 B1 6/2001 McLeod
6,263,987 B1 7/2001 Vail, III
6,273,189 B1 8/2001 Gissler et al.
6,275,938 B1 8/2001 Bond et al.
6,276,450 B1 8/2001 Seneviratne
6,290,432 B1 9/2001 Exley et al.
6,296,066 B1 10/2001 Terry et al.
6,305,469 B1 10/2001 Coenen et al.
6,311,792 B1 11/2001 Scott et al.
6,325,148 B1 12/2001 Trahan et al.
6,334,376 B1 1/2002 Torres
6,343,649 B1 2/2002 Beck et al.
6,347,674 B1 2/2002 Bloom et al.
6,357,485 B2 3/2002 Quigley et al.
6,359,569 B2 3/2002 Beck et al.
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al.
6,378,627 B1 4/2002 Tubel et al.
6,378,633 B1 4/2002 Moore
6,392,317 B1 5/2002 Hall et al.
6,397,946 B1 6/2002 Vail, III
6,401,820 B1 6/2002 Kirk et al.
6,405,798 B1 6/2002 Barrett et al.
6,408,943 B1 6/2002 Schultz et al.
6,412,574 B1 7/2002 Wardley et al.
6,419,014 B1 7/2002 Meek et al.
6,419,033 B1 7/2002 Hahn et al.
6,425,444 B1 7/2002 Metcalfe et al.
6,427,776 B1 8/2002 Hoffman et al.
6,429,784 B1 8/2002 Beique et al.
6,443,241 B1 9/2002 Juhasz et al.
6,443,247 B1 9/2002 Wardley
6,446,323 B1 9/2002 Metcalfe et al.
6,446,723 B1 9/2002 Ramons et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,494,272 B1 12/2002 Eppink et al.
6,497,280 B2 12/2002 Beck et al.
6,497,289 B1 12/2002 Cook et al.
6,527,049 B2 3/2003 Metcalfe et al.
6,527,064 B1 3/2003 Hallundbaek
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Metcalfe et al.
6,547,017 B1 4/2003 Vail, III
6,554,063 B2 4/2003 Ohmer
6,554,064 B1 4/2003 Restarick et al.
6,571,868 B2 6/2003 Victor
6,578,630 B2 6/2003 Simpson et al.
6,585,040 B2 7/2003 Hanton et al.
6,591,905 B2 7/2003 Coon
6,612,383 B2 9/2003 Desai et al.
6,619,402 B1 9/2003 Amory et al.
6,634,430 B2 10/2003 Dawson et al.
6,640,903 B1 11/2003 Cook et al.
6,648,075 B2 11/2003 Badrak et al.
6,655,460 B2 12/2003 Bailey et al.
6,666,274 B2 12/2003 Hughes
6,668,937 B1 12/2003 Murray
6,698,595 B2 3/2004 Norell et al.
6,702,029 B2 3/2004 Metcalfe et al.
6,702,040 B1 3/2004 Sensenig
6,705,413 B1 3/2004 Tessari
6,708,769 B2 3/2004 Haugen et al.
6,715,430 B2 4/2004 Choi et al.

| | | | |
|---|---|---|---|
| 6,719,071 | B1 | 4/2004 | Moyes |
| 6,722,559 | B1 | 4/2004 | Millar et al. |
| 6,725,917 | B2 | 4/2004 | Metcalfe |
| 6,725,919 | B2 | 4/2004 | Cook et al. |
| 6,725,924 | B2 | 4/2004 | Davidson et al. |
| 6,732,822 | B2 | 5/2004 | Slack et al. |
| 6,742,584 | B1 | 6/2004 | Appleton |
| 6,742,591 | B2 | 6/2004 | Metcalfe |
| 6,742,606 | B2 | 6/2004 | Metcalfe et al. |
| 6,745,834 | B2 | 6/2004 | Davis et al. |
| 6,749,026 | B2 | 6/2004 | Smith et al. |
| 6,752,211 | B2 | 6/2004 | Dewey et al. |
| 6,758,278 | B2 | 7/2004 | Cook et al. |
| 6,776,233 | B2 | 8/2004 | Meehan |
| 6,802,374 | B2 | 10/2004 | Edgar et al. |
| 6,837,313 | B2 | 1/2005 | Hosie et al. |
| 6,845,820 | B1 | 1/2005 | Hebert et al. |
| 6,848,517 | B2 | 2/2005 | Wardley |
| 6,854,533 | B2 | 2/2005 | Galloway |
| 6,857,486 | B2 | 2/2005 | Chitwood et al. |
| 6,857,487 | B2 | 2/2005 | Galloway et al. |
| 6,868,906 | B1 | 3/2005 | Vail, III et al. |
| 6,877,553 | B2 | 4/2005 | Cameron |
| 6,892,819 | B2 | 5/2005 | Cook et al. |
| 6,896,075 | B2 | 5/2005 | Haugen et al. |
| 6,899,186 | B2 | 5/2005 | Galloway et al. |
| 6,899,772 | B1 | 5/2005 | Morando |
| 6,920,932 | B2 | 7/2005 | Zimmerman |
| 6,923,255 | B2 | 8/2005 | Lee |
| 6,926,126 | B2 | 8/2005 | Baumann et al. |
| 6,941,652 | B2 | 9/2005 | Echols et al. |
| 6,953,096 | B2 | 10/2005 | Gledhill et al. |
| 7,000,695 | B2 | 2/2006 | Steele et al. |
| 7,004,264 | B2 | 2/2006 | Simpson et al. |
| 7,013,992 | B2 | 3/2006 | Tessari et al. |
| 7,013,997 | B2 | 3/2006 | Vail, III |
| 7,036,610 | B1 | 5/2006 | Vail, III |
| 7,040,420 | B2 | 5/2006 | Vail, III |
| 7,044,241 | B2 | 5/2006 | Angman |
| 7,048,050 | B2 | 5/2006 | Vail, III et al. |
| 7,082,997 | B2 | 8/2006 | Slack |
| 7,083,005 | B2 | 8/2006 | Galloway et al. |
| 7,090,004 | B2 | 8/2006 | Warren et al. |
| 7,093,675 | B2 | 8/2006 | Pia |
| 7,096,982 | B2 | 8/2006 | McKay et al. |
| 7,100,710 | B2 | 9/2006 | Vail, III |
| 7,100,713 | B2 | 9/2006 | Tulloch |
| 7,108,072 | B2 | 9/2006 | Cook et al. |
| 7,108,080 | B2 | 9/2006 | Tessari et al. |
| 7,108,083 | B2 | 9/2006 | Simonds et al. |
| 7,108,084 | B2 | 9/2006 | Vail, III |
| 7,117,957 | B2 | 10/2006 | Metcalfe et al. |
| 7,124,825 | B2 | 10/2006 | Slack |
| 7,128,154 | B2 | 10/2006 | Giroux et al. |
| 7,137,454 | B2 | 11/2006 | Pietras |
| 7,140,443 | B2 | 11/2006 | Beierbach et al. |
| 7,140,455 | B2 | 11/2006 | Walter et al. |
| 7,143,847 | B2 | 12/2006 | Pia |
| 7,147,068 | B2 | 12/2006 | Vail, III |
| 7,159,668 | B2 | 1/2007 | Herrera |
| 7,165,634 | B2 | 1/2007 | Vail, III |
| 7,311,148 | B2 | 12/2007 | Giroux et al. |
| 2001/0000101 | A1 | 4/2001 | Lovato et al. |
| 2001/0040054 | A1 | 11/2001 | Haugen et al. |
| 2001/0045284 | A1 | 11/2001 | Simpson et al. |
| 2002/0029878 | A1 | 3/2002 | Victor |
| 2002/0040787 | A1 | 4/2002 | Cook et al. |
| 2002/0066556 | A1 | 6/2002 | Goode et al. |
| 2002/0145281 | A1 | 10/2002 | Metcalfe et al. |
| 2002/0166668 | A1 | 11/2002 | Metcalfe et al. |
| 2002/0189863 | A1 | 12/2002 | Wardley |
| 2003/0029641 | A1 | 2/2003 | Meehan |
| 2003/0042022 | A1 | 3/2003 | Lauritzen et al. |
| 2003/0056991 | A1 | 3/2003 | Hahn et al. |
| 2003/0070841 | A1 | 4/2003 | Merecka et al. |
| 2003/0111267 | A1 | 6/2003 | Pia |
| 2003/0141111 | A1 | 7/2003 | Pia |
| 2003/0146023 | A1 | 8/2003 | Pia |
| 2003/0155159 | A1 | 8/2003 | Slack et al. |
| 2003/0164251 | A1 | 9/2003 | Tulloch |
| 2003/0173090 | A1 | 9/2003 | Cook et al. |
| 2003/0183424 | A1 | 10/2003 | Tulloch |
| 2003/0217865 | A1 | 11/2003 | Simpson et al. |
| 2004/0003944 | A1 | 1/2004 | Vincent et al. |
| 2004/0011534 | A1 | 1/2004 | Simonds et al. |
| 2004/0011566 | A1 | 1/2004 | Lee |
| 2004/0060697 | A1 | 4/2004 | Tilton et al. |
| 2004/0060700 | A1 | 4/2004 | Vert et al. |
| 2004/0084182 | A1* | 5/2004 | Edgar et al. ..... 166/285 |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0112693 | A1 | 6/2004 | Baumann et al. |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0182579 | A1 | 9/2004 | Steele et al. |
| 2004/0194966 | A1* | 10/2004 | Zimmerman ..... 166/380 |
| 2004/0216892 | A1 | 11/2004 | Giroux et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0238218 | A1 | 12/2004 | Runia et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0262013 | A1 | 12/2004 | Tilton et al. |
| 2005/0011643 | A1 | 1/2005 | Slack et al. |
| 2005/0051343 | A1 | 3/2005 | Pietras et al. |
| 2005/0077048 | A1 | 4/2005 | Hall |
| 2005/0152749 | A1 | 7/2005 | Anres et al. |
| 2005/0183892 | A1 | 8/2005 | Oldham et al. |
| 2005/0274547 | A1 | 12/2005 | Fincher et al. |
| 2006/0070771 | A1 | 4/2006 | McClain et al. |
| 2007/0068703 | A1 | 3/2007 | Tessari et al. |
| 2007/0079995 | A1 | 4/2007 | McClain et al. |

FOREIGN PATENT DOCUMENTS

| | | |
|---|---|---|
| CA | 2 335 192 | 11/2001 |
| DE | 3 213 464 | 10/1983 |
| DE | 3 918 132 | 12/1989 |
| DE | 4 133 802 | 10/1992 |
| EP | 0 235 105 | 9/1987 |
| EP | 0 265 344 | 4/1988 |
| EP | 0 397 323 | 11/1990 |
| EP | 0 426 123 | 5/1991 |
| EP | 0 462 618 | 12/1991 |
| EP | 0 554 568 | 8/1993 |
| EP | 0 571 045 | 11/1993 |
| EP | 0 659 975 | 6/1995 |
| EP | 0 790 386 | 8/1997 |
| EP | 0 881 354 | 4/1998 |
| EP | 0 961 007 | 12/1999 |
| EP | 0 962 384 | 12/1999 |
| EP | 1 006 260 | 6/2000 |
| EP | 1 050 661 | 11/2000 |
| FR | 2053088 | 7/1970 |
| FR | 2741907 | 6/1997 |
| FR | 2 841 293 | 12/2003 |
| GB | 540 027 | 10/1941 |

| | | |
|---|---|---|
| GB | 709 365 | 5/1954 |
| GB | 716 761 | 10/1954 |
| GB | 733596 | 7/1955 |
| GB | 7 928 86 | 4/1958 |
| GB | 8 388 33 | 6/1960 |
| GB | 881 358 | 11/1961 |
| GB | 887150 | 1/1962 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 582 392 | 1/1981 |
| GB | 2 115 940 | 9/1983 |
| GB | 2 170 528 | 8/1986 |
| GB | 2 216 926 | 10/1989 |
| GB | 2 221 482 | 7/1990 |
| GB | 2 239 918 | 7/1991 |
| GB | 2 294 715 | 8/1996 |
| GB | 2 313 860 | 2/1997 |
| GB | 2 320 270 | 6/1998 |
| GB | 2 320 734 | 7/1998 |
| GB | 2 324 108 | 10/1998 |
| GB | 2 326 896 | 1/1999 |
| GB | 2 333 542 | 7/1999 |
| GB | 2 335 217 | 9/1999 |
| GB | 2 347 445 | 9/2000 |
| GB | 2 348 223 | 9/2000 |
| GB | 2 349 401 | 11/2000 |
| GB | 2 350 137 | 11/2000 |
| GB | 2 357 101 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 381 809 | 5/2003 |
| GB | 2 382 361 | 5/2003 |
| GB | 2 386 626 | 9/2003 |
| GB | 2 389 130 | 12/2003 |
| GB | 2 396 375 | 6/2004 |
| JP | 2001-173349 | 6/2001 |
| RU | 2079633 | 5/1997 |
| WO | WO 82/01211 | 4/1982 |
| WO | WO 91-16520 | 10/1991 |
| WO | WO 92-01139 | 1/1992 |
| WO | WO 92-20899 | 11/1992 |
| WO | WO 93-24728 | 12/1993 |
| WO | WO 96-28635 | 9/1996 |
| WO | WO 97-05360 | 2/1997 |
| WO | WO 98-01651 | 1/1998 |
| WO | WO 98-09053 | 3/1998 |
| WO | WO 98-55730 | 12/1998 |
| WO | WO 99-04135 | 1/1999 |
| WO | WO 99/18328 | 4/1999 |
| WO | WO 99-23354 | 5/1999 |
| WO | WO 99-24689 | 5/1999 |
| WO | WO 99-35368 | 7/1999 |
| WO | WO 99-37881 | 7/1999 |
| WO | WO 99-50528 | 10/1999 |
| WO | WO 99-64713 | 12/1999 |
| WO | WO 00-04269 | 1/2000 |
| WO | WO 00-05483 | 2/2000 |
| WO | WO 00-28188 | 5/2000 |
| WO | WO 00-37766 | 6/2000 |
| WO | WO 00-37771 | 6/2000 |
| WO | WO 00/37772 | 6/2000 |
| WO | WO 00/37773 | 6/2000 |
| WO | WO 00-41487 | 7/2000 |
| WO | WO 00-46484 | 8/2000 |
| WO | WO 00/50730 | 8/2000 |
| WO | WO 00/50732 | 8/2000 |
| WO | WO 00-66879 | 11/2000 |
| WO | WO 00/77431 | 12/2000 |
| WO | WO 01-33033 | 5/2001 |
| WO | WO 01-46550 | 6/2001 |
| WO | WO 01/60545 | 8/2001 |
| WO | WO 01/66901 | 9/2001 |
| WO | WO 01-79650 | 10/2001 |
| WO | WO 01-81708 | 11/2001 |
| WO | WO 01-83932 | 11/2001 |
| WO | WO 01-94739 | 12/2001 |
| WO | WO 02-14649 | 2/2002 |
| WO | WO 02/29199 | 4/2002 |
| WO | WO 02-44601 | 6/2002 |
| WO | WO 02-081863 | 10/2002 |
| WO | WO 02-086287 | 10/2002 |
| WO | WO 02/092956 | 11/2002 |
| WO | WO 03-006790 | 1/2003 |
| WO | WO 03-074836 | 9/2003 |
| WO | WO 03-087525 | 10/2003 |

OTHER PUBLICATIONS

Charles O. Vail and Verne Smith, New Developments in Air-Gas Drilling and Completions, World Oil, Part Two, Dec. 1963, pp. 82-86.
GB Search Report, Application No. GB0610035.8, Dated Sep. 14, 2006.
Multilateral Case History, Onshore-Nigeria, Baker Hughes, 2000.
Multilateral Case History, Offshore Norway, Baker Hughes, 1995.
Tommy Warren, Bruce Houtchens, and Garrett Madell, Directional Drilling With Casing, SPE/IADC 79914, SPE/IADC Drilling Conference, Amsterdam, The Netherlands, Feb. 19-21, 2003, pp. 1-10.
US-U.S. Appl. No. 10/189,570, filed Jun. 6, 2002.
US-U.S. Appl. No. 10/618,093, filed Jul. 11, 2003.
Hahn, et al., "Simultaneous Drill and Case Technology—Case Histories, Status and Options for Further Development, " Society of Petroleum Engineers, IADC/SPE Drilling Conference, New Orlean, LA Feb. 23-25, 2000 pp. 1-9.
M.B. Stone and J. Smith, "Expandable Tubulars and Casing Driling are Options" Drilling Contractor, Jan./Feb. 2002, pp. 52.
M. Gelfgat, "Retractable Bits Development and Application" Transactions of the ASME, vol. 120, Jun. 1998, pp. 124-130.
Dean E. Gaddy, Editor, "Russia Shares Technical Know-How with U.S." Oil & Gas Journal, Mar. (1999), pp. 51-52 and 54-56.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
Tarr, et al., "Casing-while-Drilling: The Next Step Change in Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro. "Drilling/Completing With Tubing Cuts Well Costs By 30%," World Oil, Jul. 1998, pp. 145- 150.
Littleton, "Refined Slimhole Drilling Technology Renews Operator Interest," Petroleum Engineer International, Jun. 1992, pp. 19-26.
Anon, "Slim Holes Fat Savings." Journal of Petroleum Technology, Sep. 1992, pp. 816-819.
Anon, "Slim Holes, Slimmer Prospect," Journal of Petroleum Technology, Nov. 1995, pp. 949-952.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International. Mar. 1999, p. 15.
Silverman. "Drilling Technology—Retractable Bit Eliminates Drill String Trips," Petroleum Engineer International, Apr. 1999, p. 15.

Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Editor, "Tesco Finishes Field Trial Program," Drilling Contractor, Mar./Apr. 2001, p. 53.
Shephard, et al., Casing Drilling: An Emerging Technology, SPE Drilling & Completion, Mar. 2002, pp. 4.14.
Shephard, et al., Casing Drilling Successfully Applied in Southern Wyoming, World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 01, 2001, 8 pages.
World's First Drilling With Casing Operation From A Floating Drilling Unit, Sep. 2003, 1 page.
Filippov, et el., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SSP Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al., "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Mckay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conferece, Mar. 6-7, 2003, pp. 1-7.
Maute, "Electrical Logging: State-of-the Art," The Log Analyst, May-Jun. 1992, pp. 206-27.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Valves Wellhead Equipment Safety Systems, W-K-M Division, ACF Industries, Catalog 80, 1980, 5 Pages.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utitizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters And Maturing Properities, IBP 27500, Brazilian Petroleum Institute—IBP, 2000.
Tessari, Robert M., Warren, Tommy, And Houtchens, Bruce, Retrievable Tools Provide Flexibility for Casing Drilling, World Oil, Casing Drilling Technical Conference, WOCD-0306-01, 2003, pp. 1-11.
GB Examination Report for Application No. GB0610035.8 dated Jan. 19, 2010.

* cited by examiner

RETRACTABLE JOINT AND CEMENTING SHOE FOR USE IN COMPLETING A WELLBORE

CROSS-REFERENCE TO RELATED APPLICATIONS

This application claims the benefit of U.S. Provisional Patent Application No. 60/683,070, filed May 20, 2005.

This application is a continuation-in-part of U.S. patent application Ser. No. 11/140,858, filed May 31, 2005, now U.S. Pat. No. 7,083,005, which is a continuation of U.S. patent application Ser. No. 10/319,792, filed Dec. 13, 2002, now U.S. Pat. No. 6,899,186. The aforementioned related patent applications and patents are herein incorporated by reference.

BACKGROUND OF THE INVENTION

1. Field of the Invention

The present invention generally relates to apparatus and methods for completing a well. Particularly, the present invention relates to a retractable joint and/or a cementing shoe for use with conventional well completions and with drilling with casing applications.

2. Description of the Related Art

In the oil and gas producing industry, the process of cementing casing into the wellbore of an oil or gas well generally comprises several steps. For example, a section of a hole or wellbore is drilled with a drill bit which is slightly larger than the outside diameter of the casing which will be run into the well. Next, a string of casing is run into the wellbore to the required depth where the casing lands in and is supported by a well head.

Next, cement slurry is pumped into the casing to fill the annulus between the casing and the wellbore. The cement serves to secure the casing in position and prevent migration of fluids and gasses between formations through which the casing has passed. Once the cement hardens, a smaller drill bit is used to drill through the cement in the shoe joint and further into the formation.

Typically, when the casing string is suspended in a subsea casing hanger, the length of the casing string is shorter than the drilled open hole section, allowing the casing hanger to land into the wellhead prior to reaching the bottom of the open hole. Should the casing reach the bottom of the hole prior to landing the casing hanger, the casing hanger would fail to seal and the casing would have to be retrieved or remedial action taken.

In some instances, the area between the end of the casing (sometimes called the "shoe") and the end of the drilled open hole can become eroded to an even larger diameter than the original open hole. A typical cementing operation fills the volume between the annulus and casing above the shoe with cement, but not the section below the shoe. When the next section of open hole is drilled and casing is run, this increased diameter below the previous casing string allows mud circulation velocity to decrease, leaving debris and cuttings in this hole. The debris and cuttings can lead to pack off problems and trouble logging the well.

One prior art solution is disclosed in U.S. Pat. No. 5,566,772 (Coone, et al., issued Oct. 22, 1996). This solution uses pressurized fluid to extend a tubular member to the bottom of the open hole section once the casing has been landed. Pressure and/or circulation is required to activate the system. In one embodiment, a plug must be dropped from the surface to seal the bore of the casing shoe. This wastes valuable rig time.

If the plug is dropped prior to landing the casing, the potential exists to set the shoe prematurely or restrict circulation. In formations where this enlarged section exists, activating and extending the shoe with pressure is likely to surge and damage the formation leading to other problems such as loss of drilling fluid and cement into the formation.

Therefore, there exists a need in the art for an improved method and/or apparatus for completing a subsea wellbore.

SUMMARY OF THE INVENTION

An improved method and/or apparatus for completing a wellbore is provided. In one embodiment, a method of lining a pre-drilled wellbore is provided. The method includes the act of providing a casing assembly, the casing assembly including a string of casing; and a retractable joint comprising an inner tubular and an outer tubular. The method further includes the acts of running the casing assembly into the pre-drilled wellbore; and actuating the retractable joint, thereby reducing the length of the casing assembly through movement between the inner and outer tubulars.

In one aspect of the embodiment, the retractable joint comprises a shearable member coupling the inner and outer tubulars. The act of actuating the retractable joint may include setting at least some of the weight of the casing on the retractable joint, thereby breaking the shearable member. In another aspect of the embodiment, the casing assembly further includes a hanger and the method further comprises landing the hanger into a casinghead. In another aspect of the embodiment, the method further includes the act of injecting cement through the casing assembly and into an annulus between the casing assembly and the wellbore. In another aspect of the embodiment, the retractable joint is disposed at an end of the casing string distal from a surface of the wellbore. In another aspect of the embodiment, the casing assembly further includes a second retractable joint.

In another aspect of the embodiment, the retractable joint further includes an anti-rotation member coupling the inner and outer tubulars. The anti-rotation member may include a slip, a ball, a shearable member, or a spline. In another aspect of the embodiment, the outer tubular has a vane disposed on an outer surface thereof. In another aspect of the embodiment, the length of the casing assembly is greater than a depth of the wellbore. In another aspect of the embodiment, the casing assembly further comprises a guide shoe and the act of running comprises running the casing assembly into the pre-drilled wellbore until the guide shoe rests on the bottom of the wellbore.

In another aspect of the embodiment, the casing assembly further includes a guide shoe, the guide shoe including a body comprising an axial bore therethrough and at least one port through a wall thereof; a liner covering the port, the lining configured to rupture at a predetermined pressure; and a nose disposed on the body and made from a drillable material and having a bore therethrough. The nose may have a blade disposed on an outer surface thereof. The body may have a vane disposed on an outer surface thereof. The liner may be made from a drillable material. The body may further include a second port through the wall thereof. The second port may be covered by the liner or a second liner having a thickness substantially equal to the thickness of the liner. The first port may be axially disposed proximate to the nose. The second port may be axially disposed distal from the nose, and the diameter of the second port is less than the diameter of the first port. The body may further include a second port through the wall thereof. The second port may be covered by a second liner having a thickness greater than the thickness of the liner.

The first port may be axially disposed proximate to the nose. The second port may be axially disposed distal from the nose. The diameter of the second port may be substantially equal to the diameter of the first port. The method may further include the act of injecting wellbore fluid through the casing assembly, wherein the pressure will increase inside the guide shoe, thereby rupturing the liner. The method may further include the act of drilling through the nose of the guide shoe.

In another aspect of the embodiment, the retractable joint is configured so that the inner tubular will slide into the outer tubular when the retractable joint is actuated. In another aspect of the embodiment, the retractable joint is configured so that the outer tubular will slide over the inner tubular when the retractable joint is actuated and the inner tubular is made from a drillable material.

In another embodiment, a guide shoe for use with a string of casing in a wellbore is provided. The guide shoe includes a body including an axial bore therethrough and at least one port through a wall thereof; a liner covering the port, the liner configured to rupture at a predetermined pressure; and a nose disposed on the body, made from a drillable material, and having a bore therethrough.

In one aspect of the embodiment, the nose has a blade disposed on an outer surface thereof. In another aspect of the embodiment, the body has a vane disposed on an outer surface thereof. In another aspect of the embodiment, the liner is made from a drillable material. In another aspect of the embodiment, the body further includes a second port through the wall thereof. The second port may be covered by the liner or a second liner having a thickness substantially equal to the thickness of the liner. The first port may be axially disposed proximate to the nose and the second port may be axially disposed distal from the nose. The diameter of the second port may be less than the diameter of the first port.

In another aspect of the embodiment, the body further includes a second port through the wall thereof. The second port may be covered by a second liner having a thickness greater than the thickness of the liner. The first port may be axially disposed proximate to the nose and the second port may be axially disposed distal from the nose. The diameter of the second port may be substantially equal to the diameter of the first port.

In another aspect of the embodiment, a method of using the shoe is provided. The method includes the acts of attaching the guide shoe to a string of casing; running the guide shoe into a wellbore; and injecting cement through the casing to the guide shoe, wherein the pressure will increase inside the guide shoe, thereby rupturing the liner. The method may further include drilling through the nose of the guide shoe.

In another embodiment, a retractable joint for use with a string of casing in a wellbore is provided. The retractable joint includes an outer tubular having an inside diameter for a substantial portion thereof; an inner tubular having an outside diameter for a substantial portion thereof, wherein the outside diameter is less than the inside diameter; and an axial coupling axially coupling the inner tubular to the outer tubular.

In another aspect of the embodiment, the axial coupling includes a shearable member. In another aspect of the embodiment, the axial coupling includes a slip. In another aspect of the embodiment, the retractable joint further includes a seal disposed between the inner and outer tubulars. In another aspect of the embodiment, an end of the inner tubular has a second outside diameter that is greater than the inside diameter. In another aspect of the embodiment, the retractable joint further includes an anti-rotation member coupling the inner and outer tubulars. In another aspect of the embodiment, the anti-rotation member includes a slip. In another aspect of the embodiment, the anti-rotation member includes a ball. In another aspect of the embodiment, the anti-rotation member includes a shearable member. In another aspect of the embodiment, the anti-rotation member includes a spline. In another aspect of the embodiment, the outer tubular has a vane disposed on an outer surface thereof.

In another embodiment, a method for manufacturing a retractable joint for shipment to a well-site is provided. The method includes the acts of manufacturing an outer sleeve, an outer casing, an inner sleeve, and a crossover; sliding the outer sleeve over the inner sleeve; attaching the outer casing to the outer sleeve; attaching the crossover to the inner sleeve; sliding the crossover into the outer casing; attaching the outer sleeve to the crossover with temporary retainers; and sending the retractable joint to the well-site.

In one aspect of the embodiment, the method further includes the acts of receiving the retractable joint at the well-site; removing the temporary retainers; extending the retractable joint; inserting shear members; and attaching the retractable joint to a string of casing.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 2A is an enlarged cross-sectional view illustrating the retractable joint and the guide shoe in an extended position.

FIG. 5 is a cross-sectional view illustrating the casing assembly after the guide shoe has been drilled through.

DETAILED DESCRIPTION OF THE PREFERRED EMBODIMENT

All references to directions, i.e. upper and lower, are for embodiment(s) to be used in vertical wellbores. These references are not meant to limit the embodiment(s) in any way as they may also be used in deviated or horizontal wellbores as well where the references may lose their meaning. Unless otherwise specified and except for sealing members all components are typically constructed from a metal, such as steel. However, the components may also be constructed from a composite, such as fiberglass. Unless otherwise specified, sealing members are typically constructed from a polymer, such as an elastomer. However, metal-to-metal sealing members may also be employed.

Figure 1:
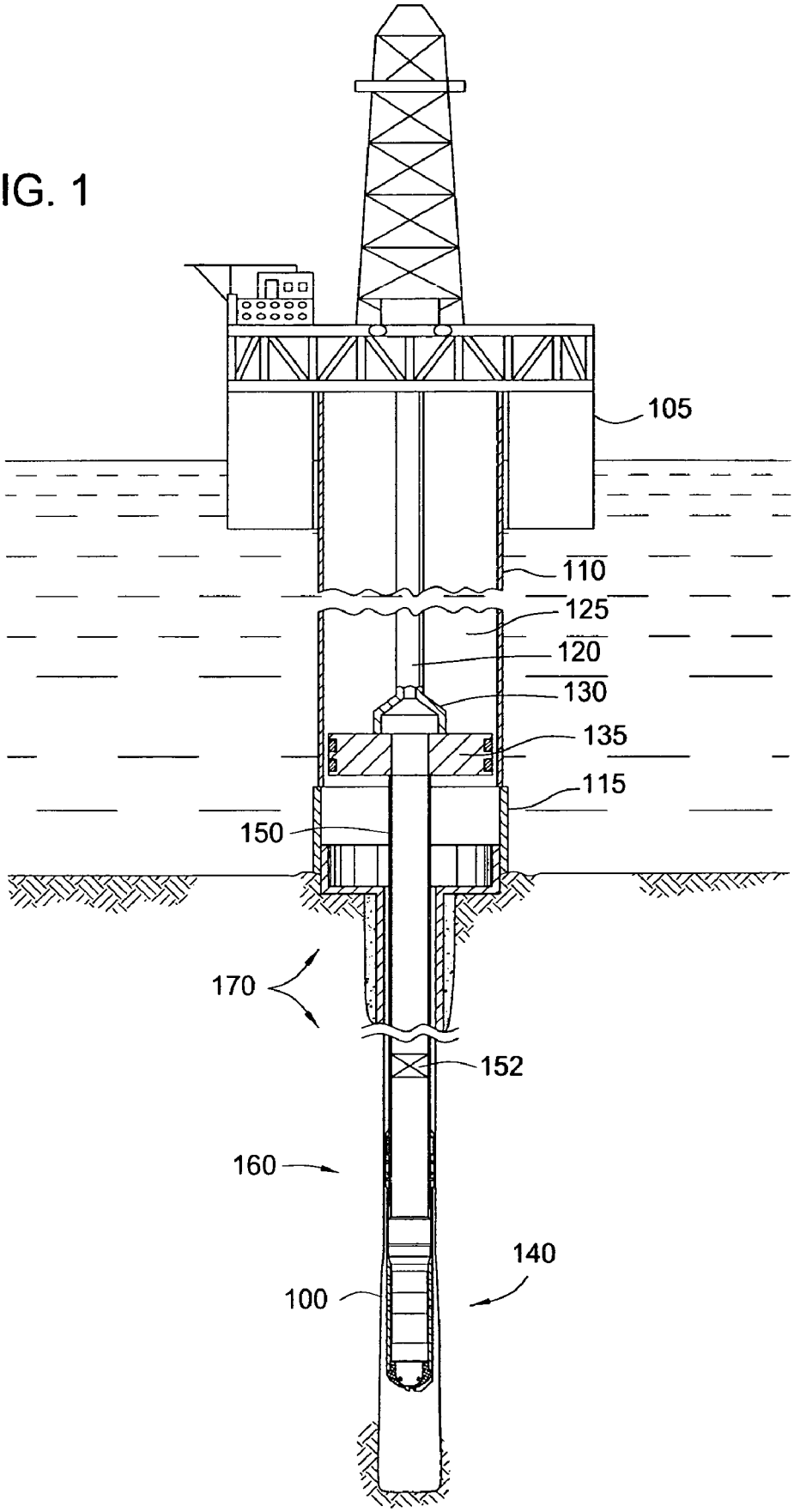
FIG. 1 is a partial section view and illustrates the formation of a subsea wellbore with a casing string having a drill bit or guide shoe disposed at a lower end thereof.

FIG. 1 illustrates a run-in operation of a pre-drilled subsea wellbore 100 with a casing assembly 170 in accordance with one embodiment of the present invention. Although the illustrated embodiments are employed with the subsea wellbore 100, other embodiments include application to land based wellbores. Typically, offshore drilling in deep water is conducted from a floating vessel 105 that supports the drill rig and derrick and associated drilling equipment. A riser pipe 110 is normally used to interconnect the floating vessel 105 and a subsea wellhead 115. A run-in string 120 extends from the floating vessel 105 through the riser pipe 110. The riser pipe 110 serves to guide the run-in string 120 into the subsea wellhead 115 and to conduct returning drilling fluid back to the floating vessel 105 during the run-in operation through an annulus 125 created between the riser pipe 110 and the run-in string 120. The riser pipe 110 is illustrated larger than a standard riser pipe for clarity.

A running tool 130 is disposed at the lower end of the run-in string 120. Generally, the running tool 130 is used in the placement or setting of downhole equipment and may be retrieved after the operation or setting process. The running tool 130 is used to connect the run-in string 120 to the casing assembly 170 and subsequently release the casing assembly 170 after the casing assembly 170 is set.

The casing assembly 170 may include a casing hanger 135, a string of casing 150, a float or landing collar 152, a retractable joint 160, and a shoe, such as circulation guide shoe 140. The casing hanger 135 is disposed at the upper end of the string of casing 150. The casing hanger 135 is constructed and arranged to seal and secure the string of casing 150 in the subsea wellhead 115. As shown on FIG. 1, the retractable joint 160 is disposed at the bottom of the string of casing 150. However, it should be noted that the retractable joint 160 is not limited to the location illustrated on FIG. 1, but may be located at any point on the string of casing 150. Further, more than one retractable joint 160 may be disposed in the string of casing 160.

The guide shoe 140 is disposed at a lower end of the shoe joint 160 to guide the casing assembly 170 into the wellbore 100 and to remove any obstructions encountered in the wellbore 100. During run in, the casing assembly 170 may be rotated and urged downward using the guide shoe 140 to remove any obstructions. Typically, drilling fluid is pumped through the run-in string 120 and the string of casing 150 to the guide shoe 140. In this respect, the run-in string 120, the run-in tool 130, and the casing assembly 170 act as one rotationally locked unit to guide the casing assembly 170 into the wellbore 100.

In an alternative embodiment, a drill bit (not shown) may be disposed at the lower end of the shoe joint 160 instead of the guide shoe 140. In this alternative embodiment, the casing 150 and the drill bit would be used in a drilling with casing operation instead of being run in to the pre-drilled wellbore 100 (see FIGS. 1-4 along with the discussion thereof in the '186 Patent).

In another alternative embodiment, again to be used in a drilling with casing operation, a casing drilling shoe, as disclosed in Wardley, U.S. Pat. No. 6,443,247 which is incorporated herein in its entirety, may be disposed at the lower end of the shoe joint 160 instead of the guide shoe 140. Generally, the casing drilling shoe disclosed in the '247 Patent includes an outer drilling section constructed of a relatively hard material such as steel, and an inner section constructed of a readily drillable, preferably polycrystalline diamond compact (PDC) drillable, material such as aluminum. The drilling shoe further includes a device for controllably displacing the outer drilling section to enable the shoe to be drilled through using a standard drill bit and subsequently penetrated by a reduced diameter casing string or liner.

Figure 2:
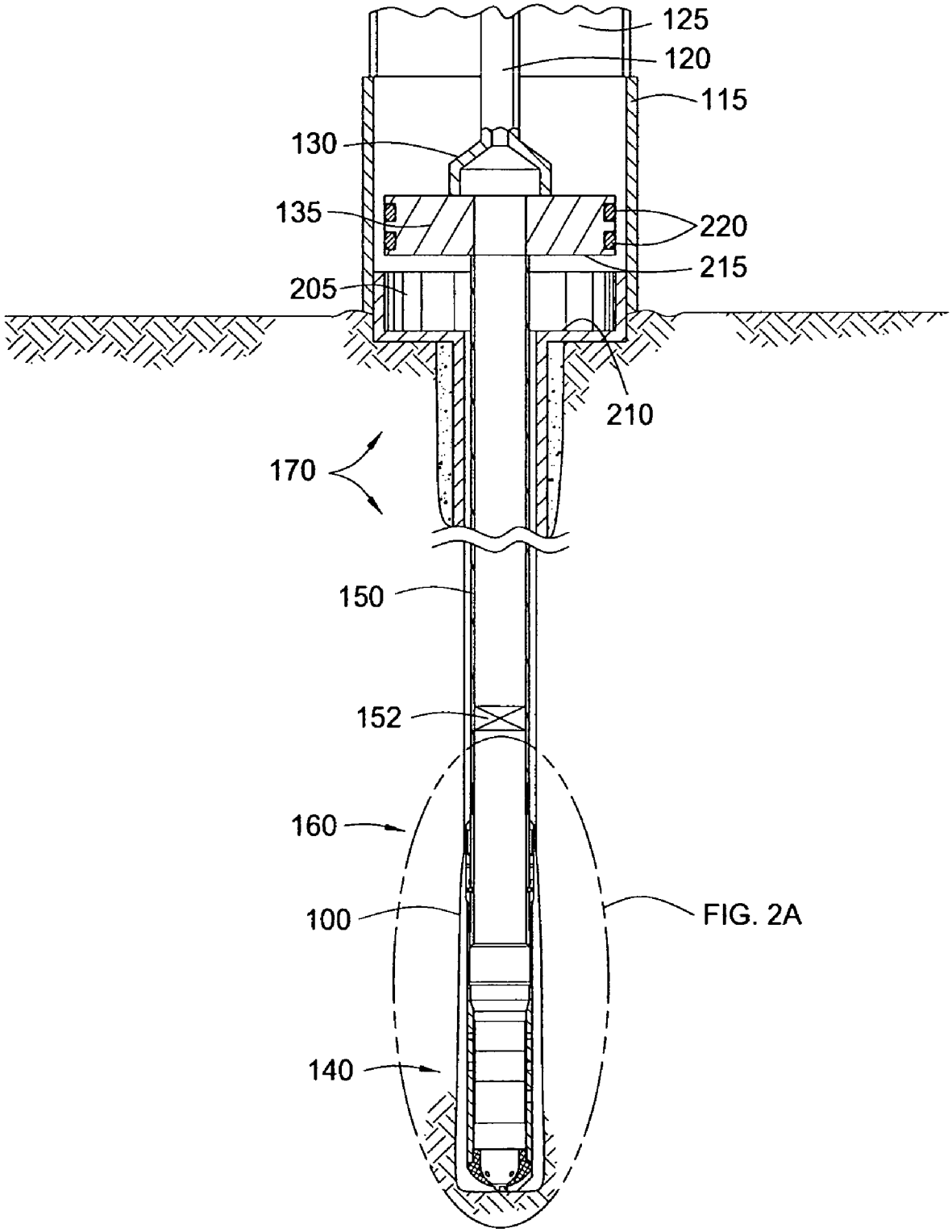
FIG. 2 is a cross-sectional view illustrating the string of casing prior to setting a casing hanger into a casing hanger of the subsea wellhead.

FIG. 2 is a cross-sectional view illustrating the casing assembly 170 prior to setting the casing hanger 135 into a casinghead 205. Preferably, the casing assembly 170 is run in until the guide shoe 140 is at the bottom of the wellbore 100 and the length of the casing assembly 170 is slightly longer than the depth of the wellbore so that the casing hanger 135 is proximate to, but not seated in, the casinghead 205. The rotation of the casing 150 is then stopped.

The casing hanger 135 and casinghead 205 may be conventional and as such are not shown in detail. One exemplary casing hanger 135 includes one or more elastomer seals 220 which may be actuated to expand one or more metal seal lips (not shown) into engagement with the casinghead 205. The resulting seal between the casing hanger 135 and the casinghead 205 is thus a metal-to-metal seal backed up by an elastomer seal 220. Such a casing hanger 135 and casinghead 205 is manufactured by Vetco Gray™ under the name SG-5 Subsea Wellhead System™. Other suitable subsea wellhead systems include MS-700 Subsea Wellhead System™ also manufactured Vetco Gray™ and other conventional wellhead systems manufactured by other providers. In land based embodiments, any conventional casing hanger may be used.

As shown in FIG. 2, the casinghead 205 is disposed in the subsea surface. Typically, the casinghead 205 is located and cemented in the subsea surface prior to drilling the wellbore 100. The casinghead 205 is typically constructed from steel. However, other types of materials may be employed so long as the material will permit an effective seal between the casing hanger 135 and the casinghead 205. The casinghead 205 includes a landing shoulder 210 formed at the lower end of the casinghead 205 to mate with the lower surface 215 formed on the lower end of the casing hanger 135.

Figure 2A:
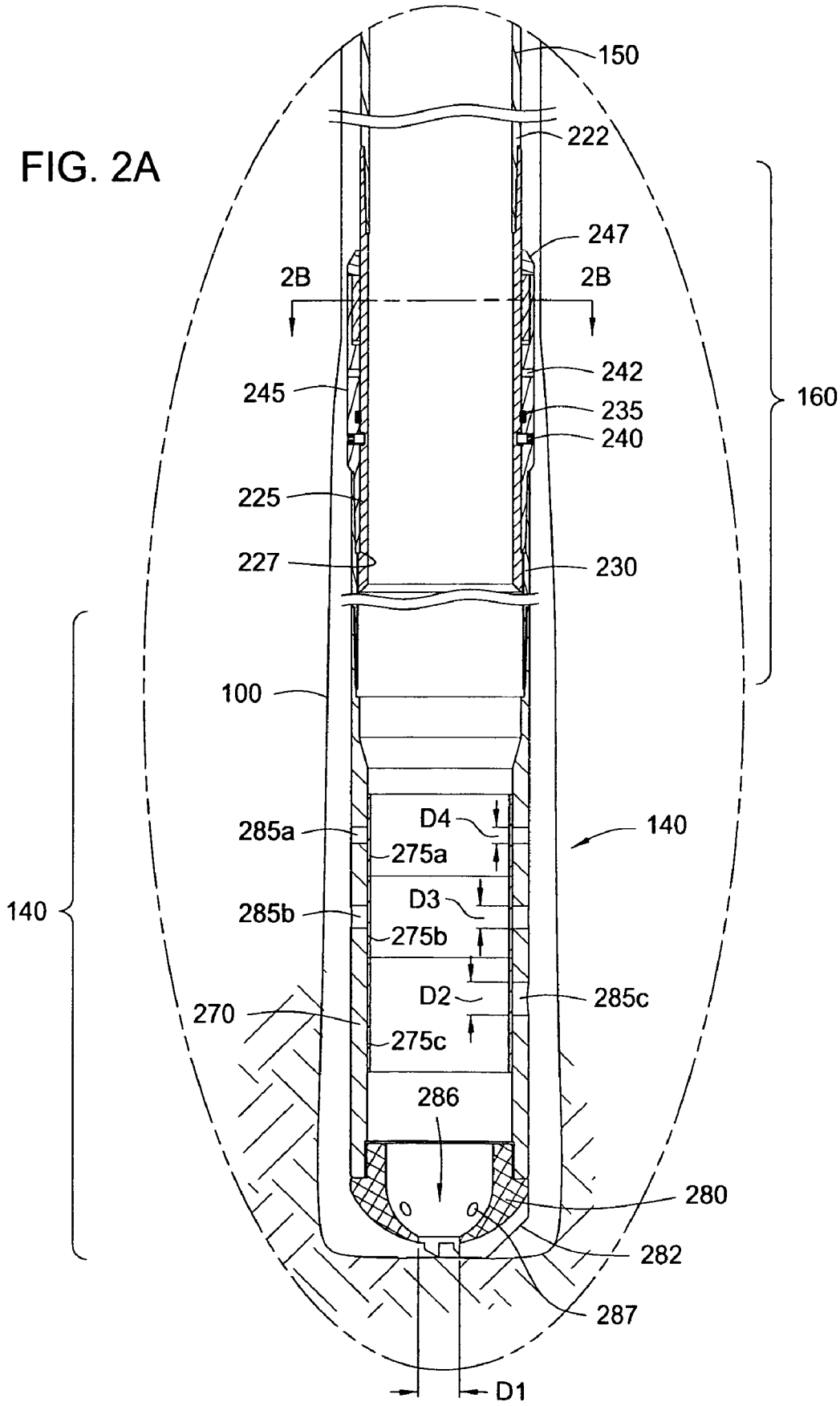
FIG. 2A is an enlarged cross-sectional view illustrating a retractable apparatus of the casing string in a first position.
Figure 2D:
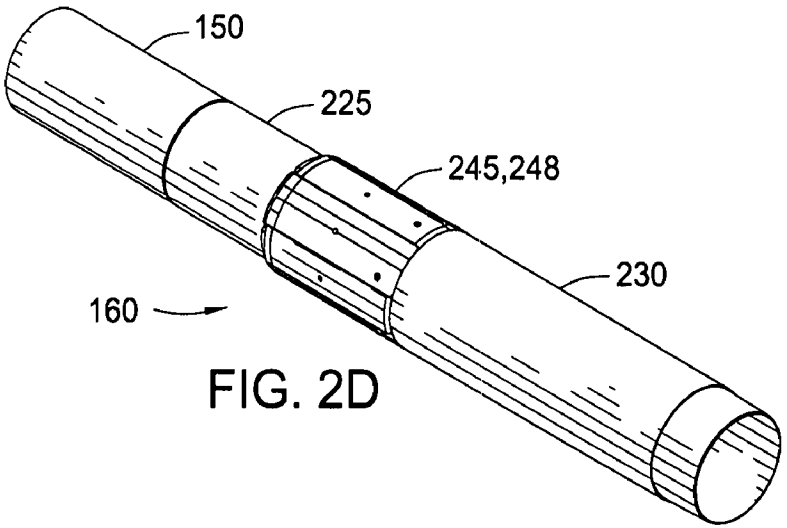
FIG. 2D is an isometric view of the retractable joint.
Figure 2F:
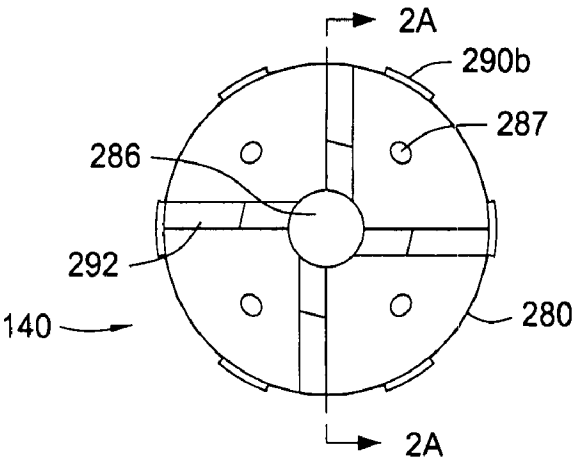
FIG. 2F is a bottom end view of the guide shoe.
Figure 2B:
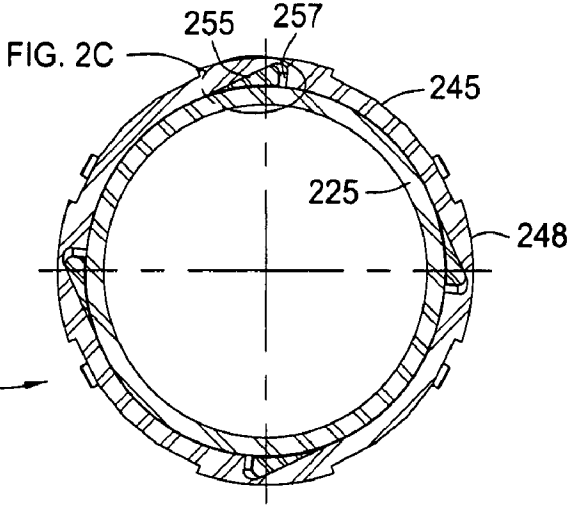
FIG. 2B is a sectional view taken along line 2B-2B of FIG. 2A.
Figure 2C:
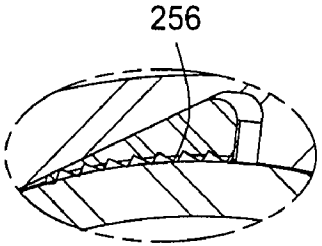
FIG. 2C is an enlarged view of a portion of FIG. 2B.

FIG. 2A is an enlarged cross-sectional view illustrating the retractable joint 160 and the guide shoe 140 in an extended position. FIG. 2B is a sectional view taken along line 2B-2B of FIG. 2A. FIG. 2C is an enlarged view of a portion of FIG. 2B. FIG. 2D is an isometric view of the retractable joint 160. When actuated, the retractable joint 160 moves from an extended position to a retracted position allowing the overall length of the casing assembly 170 to be reduced. As the casing assembly 170 length is reduced, the casing hanger 135 may seat in the casinghead 205 sealing the subsea wellhead 115 without damaging the one or more seals 220. In doing so, the guide shoe 140 remains seated on the bottom of the wellbore 100. Placing the end of the outer casing at the bottom of the wellbore allows the entire length of open hole to be circulated and cemented, eliminating the risk that debris and cuttings will be trapped in the enlarged open hole section. Further, if an obstruction in the wellbore 100 is encountered during run in of the casing assembly 170 which cannot be bypassed or removed by the guide shoe 140, the retractable joint 160 may be actuated thereby reducing the axial length of the casing assembly 170 and allowing the casing hanger 135 to land in the casinghead 205 (provided the retraction length of the retractable joint 160 is sufficient to accommodate the length of casing 150 extending from the wellbore 100).

The retractable joint 160 may include a crossover sub 222, tubular inner sleeve 225, an outer tubular casing 230, a tubular outer sleeve 245, one or more shear members, such as shear screws 240, one or more anti-rotation members, such as gripping members 255, and one or more seals 235. The crossover 222 is coupled to the casing 150 at an upper end with a standard casing coupling (not shown) and is coupled to the inner sleeve 225 with a flush type threaded joint to clear the inner diameter of the outer sleeve 245. Alternatively, the crossover 222 may be omitted if casing 150 is flush jointed. The outer sleeve 245 is coupled to the outer casing 230 by a threaded or other type of connection. The outer diameter of the inner sleeve 225 tapers to form a stop shoulder 227. The stop shoulder 227 is configured to mate with a bottom edge of the outer sleeve 245 to prevent the retractable joint 160 from separating from the casing 150 after the shear screws 240 have been broken in case the retractable joint 160 must be removed from the wellbore 100 or in case the shear screws 240 fail prematurely, i.e., if an obstruction is encountered in the wellbore at a location where the retraction length of the retractable joint 160 is not sufficient to seat the casing hanger 135 in the casinghead 205. The seal 235 is disposed in a radial groove formed in an inner surface of the outer sleeve 245. The outer sleeve 245 is configured to receive the inner sleeve 225 (except for the larger diameter portion) and the crossover 222 therein. The outer casing 230 is configured to receive the inner sleeve 225 and the crossover 222 therein. The outer casing 230 and crossover 222 are constructed of a predetermined length to allow the casing hanger 135 to seat properly in the casinghead 205.

Alternatively, the retractable joint 160 may be constructed and arranged to permit the casing 150 to slide there-over to obtain a similar result. However, this alternative would reduce the size of a second string of casing that may be run through the retractable joint after cementing and drill through of the retractable joint. To alleviate this shortcoming, the inner casing could be made of a drillable material, such as a composite so that it may be drilled out before running the second string of casing or be made of an expandable metal material so that it may be expanded to the same or larger diameter as the casing 150.

A circumferential groove is formed in the outer surface of the inner sleeve 225 and one or more corresponding threaded holes are disposed through the outer sleeve 245 which together receive the shear screws 240. The shear screws 240 couple the inner sleeve 225 and the outer sleeve 245 together axially. Alternatively, the groove may instead be one or more depressions or slots so that the shear screws may also rotationally couple the inner sleeve 225 and the outer sleeve 245 together. Alternatively, the shear members may be wire, pins, rings, other shear-able retaining member(s), or may be a biasing member, such as a spring. The shear screws 240 are used to retain the outer casing 230 and the outer sleeve 245 in a fixed position until sufficient axial force is applied to cause the shear screws 240 to fail. Preferably, this axial force is applied by releasing some or all of the weight of the casing 150 supported from the floating vessel 105 on to the retractable joint 160. Alternatively, a setting tool (not shown) or hydraulic pressure may be employed to provide the axial force required to cause the locking mechanism 310 to fail. Once the shear screws 240 fail, casing 150 may then move axially downward to reduce the length of the casing assembly 170.

Formed on an inner surface of the outer sleeve 245 are grooves, each having an inclined surface. A gripping member, such as a slip 255, is disposed in each of the inclined grooves of the outer sleeve 245 and has an inclined outer surface formed thereon which mates with the inclined groove of the outer sleeve 245, thereby creating a wedge action when the slips are actuated. The slips 255 are axially retained in the inclined grooves by a cap 247, which is coupled to the outer sleeve by fasteners, such as cap screws or threads. A biasing member, such as spring 257 is disposed in each inclined groove to bias each slip 255 into an extended or actuated position in contact with the inner sleeve 225 (or the crossover 222 depending on the axial position of the retractable joint 160). The slip 255 has teeth 256 formed on an inner surface thereof. The teeth 256 may be hard, i.e. tungsten carbide, inserts disposed on the slips 255 or a hard coating or treatment applied to the slips 255. The teeth 256 penetrate or "bite into" an outer surface of the inner sleeve 225/crossover 222 when the slips 255 are actuated.

When the inner sleeve 225/crossover 222 is rotated clockwise (when viewed from the surface of the wellbore 100), the inner sleeve 225/crossover 222 will push the slips up the inclined surface and into the radial groove against the resistance of the spring 257. Other than overcoming the resistance of the spring, the inner sleeve 225/crossover 222 is allowed to rotate freely relative to the outer sleeve 245 in the clockwise direction. When the inner sleeve 225/crossover 222 is rotated in the counter-clockwise direction, the slips 255 will slide down the inclined surfaces of the outer sleeve 245 and out of the inclined grooves, thereby rotationally coupling the inner sleeve 225 to the outer sleeve 245. Alternatively, a second set of slips could be added to rotationally couple the inner sleeve 225/crossover 222 to the outer sleeve 245 in both directions or the slip-groove coupling could be inverted in orientation so that it locks in the clockwise direction.

Alternatively, a second set of shear screws disposed in axial grooves may be employed to transmit torque between the inner sleeve 225/crossover 222 and the outer sleeve 245. The shear screw assembly may be disengaged by axial movement of one member relative to the other member caused by applied weight of the casing string, thereby permitting rotational freedom of each member. Alternatively, a spline assembly may be employed to transmit the torque between the inner sleeve 225/crossover 222 and the outer sleeve 245. The spline assembly may be disengaged by axial movement of one member relative to the other member, thereby permitting rotational freedom of each member. Alternatively, a ratchet mechanism may be employed to transmit torque between the inner sleeve 225/crossover 222 and the outer sleeve 245. Alternatively, a clutch mechanism may be employed to transmit torque between the inner sleeve 225/crossover 222 and the outer sleeve 245. The clutch mechanism may be actuated hydraulically, by setting down the weight of the casing 150, or by a setting tool.

Formed In an outer surface of the outer sleeve 245 may be one or more vanes 248. The vanes 248 serve as reaming members during run in of the casing assembly 170, as centralizers, and as anti-rotation members after cementing. During cementing, the areas between the vanes 248 will be filled with cement, thereby rotationally coupling the outer sleeve 245 to the wellbore 100.

If the retractable joint 160 is assembled prior to shipping to the floating vessel 105, one or more temporary retaining members, such as a set screws (not shown), are disposed in holes 242 disposed through the outer sleeve 225. The temporary set screws couple the inner sleeve 225/crossover 222 to the outer sleeve 245 to retain the retractable joint 160 in a retracted position for shipping and handling. The set screws may then be removed from the retractable joint 160 upon delivery to the floating vessel. The retractable joint 160 may then be extended and the set screws installed prior to run-in of the retractable joint into the wellbore 100.

Figure 2E:
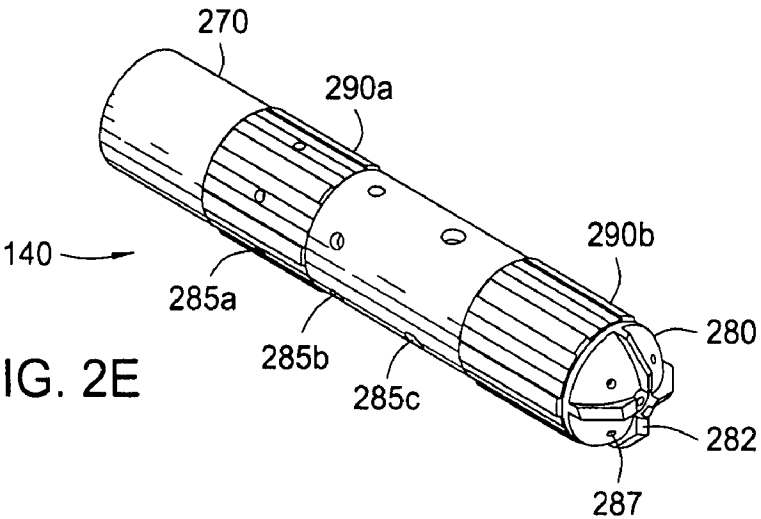
FIG. 2E is an isometric view of the guide shoe.

FIG. 2E is an isometric view of the guide shoe 140. FIG. 2F is a bottom end view of the guide shoe 140. The guide shoe 140 includes a body 270 and a nose 280. The body 270 is a tubular member and is coupled to a lower end of the retractable joint 160 by a threaded or welded connection. The body 270 has a main axial bore therethrough. Formed on the outside of the guide shoe 140 are one or more sets 290*a,b* of one or more vanes. The vanes 290*a,b* serve as reaming members during run in of the casing assembly 170, as centralizers, and as anti-rotation members after cementing and during drill through of the nose portion 280. During cementing, the areas between the vanes 290*a,b* will be filled with cement, thereby rotationally coupling the body 270 to the wellbore 100.

Coupled to a bottom end of the body 270 by a threaded connection is the nose 280. The nose 280 is a convex member made from a drillable material, usually a non-ferrous PDC drillable material, such as aluminum (preferred), cement, brass, or a composite material. The nose 280 has an axial bore therethrough which is in communication with a main port 286 through a bottom tip having a diameter D1. Disposed through a side of the nose are one or more jet ports 287. The jet ports 287 discharge drilling fluid during run-in of the casing assembly 170. Disposed on an outer surface of the nose are one or more blades 282. The blades 282 will serve to remove any obstacles encountered by the guide shoe 140 during circulation through the casing assembly 170.

Disposed through a wall of the body 270 are one or more sets 285*a-c* of one or more circulation ports having diameters D2-D4, respectively. The diameters decrease from D2 to D4 (D2>D3>D4). Lining an inner side of the body 270 and covering each set of circulation ports 285*a-c* is/are one or more frangible members, such as burst tubes 275*a-c*, respectively. Alternatively, the burst tubes 275*a-c* may be disposed on the outside of the body. Alternatively, the burst tubes 275*a-c* may be replaced by a single burst tube. The burst tubes are normally made from a PDC drillable material, such as a non-ferrous metal, a polymer, or a composite material. The thicknesses of the burst tubes 275*a-c* are equal or substantially equal. The burst pressure of each of the burst tubes 275*a-c* will be inversely proportional to the diameters (including higher order relations, i.e. burst pressure inversely proportional to diameter squared) D2-D4 of the circulation ports 285*a-c*.

After the casing assembly 170 has been landed and set into the casinghead 205, there exists a need to ensure that the well is circulated and cemented from the lowest possible location of the open hole section which is typically at the guide shoe 140. This allows maximum removal of cuttings and debris from the open hole section and cement to be placed beginning at in the lowest portion of the well. However, utilizing string weight to collapse the joint 160 increases the possibility of plugging the main port 286 and the jet ports 287, which could prevent circulation and cementing. In the event that the guide shoe 140 was to become plugged, pressure would be increased to rupture one or more of the burst tubes 275*a-c*, thereby activating one or more of the circulation ports 285*a-c*. Pressure increase inside the guide shoe 140 will cause the unsupported area of the burst tubes 275*a-c* covering the circulation ports 285*a-c* to fail. The burst tubes 275*a-c* will fail at the largest unsupported area first, allowing circulation to be initially established at the lowest set 285*c* of circulation ports.

Another method to allow alternate circulation paths is the use of rupture disks in the guide shoe instead of the burst tubes 275*a-c*. Rupture disks with higher pressures can be positioned at higher locations in the guide shoe 140 to ensure circulation and cementing is initiated from the lowest portion of the well.

Figure 3:
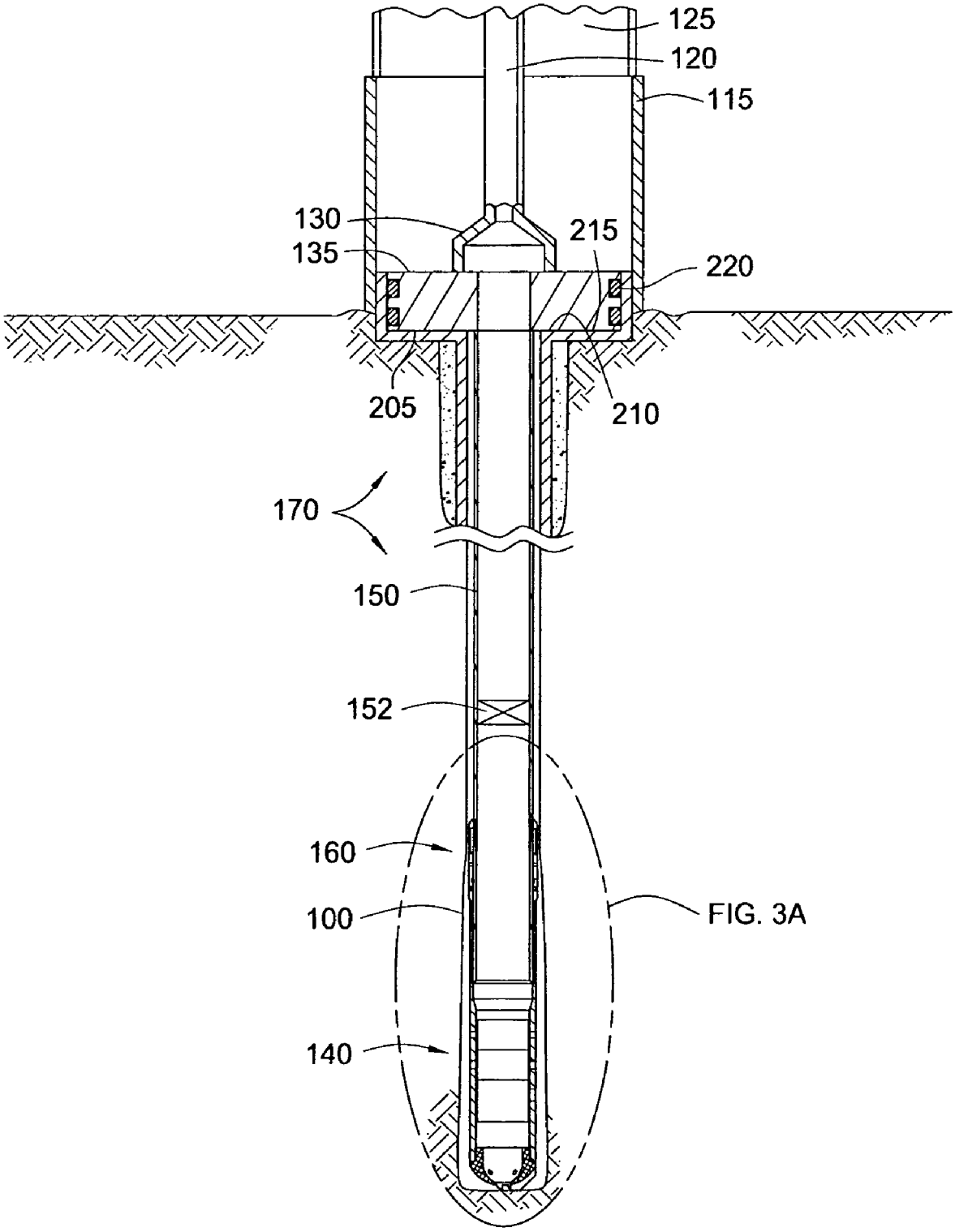
FIG. 3 is a cross-sectional view illustrating the casing assembly after the casing hanger is seated in the casing hanger.
Figure 3A:
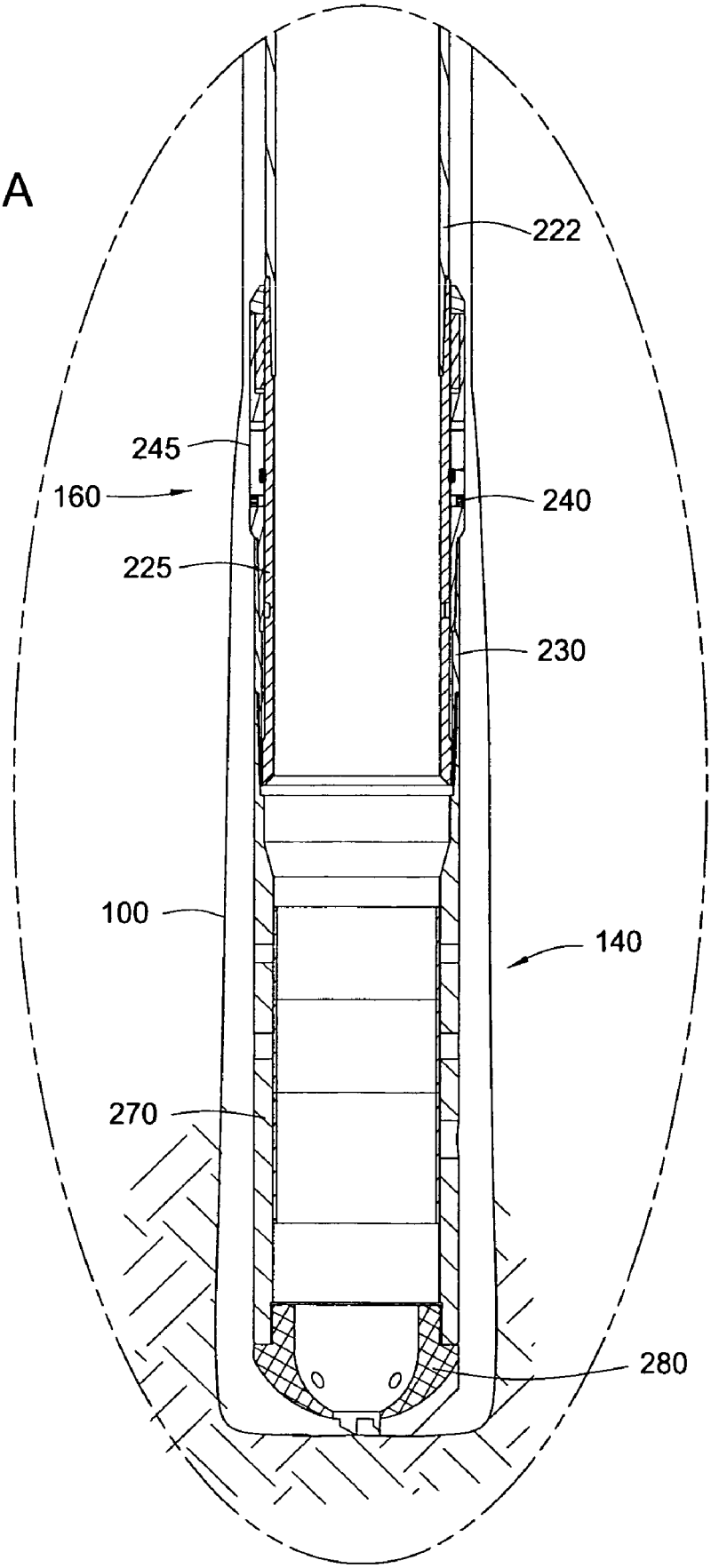
FIG. 3A is an enlarged cross-sectional view illustrating the retractable apparatus in a retracted position after the casing hanger is set into the casing hanger.

FIG. 3 is a cross-sectional view illustrating the casing assembly 170 after the casing hanger 135 is seated in the casinghead 205. FIG. 3A is an enlarged view of the retractable joint 160 and the guide shoe 140. An axial force was applied to the crossover 222 causing the shear members 240 to fail and allow the crossover 222 to move axially downward and slide into the outer casing 230. The lower surface 215 of the casing hanger 135 has contacted the landing shoulder 210 of the casinghead 205, thereby seating the casing hanger 135 in the casinghead 205. As further illustrated, the one or more seals 220 on the casing hanger 135 are in contact with the casinghead 205, thereby creating a fluid tight seal between the casing hanger 135 in the casinghead 205 during the drilling and cementing operations. In this manner, the length of the casing assembly 170 is reduced allowing the casing hanger 135 to seat in the casinghead 205.

Figure 4:
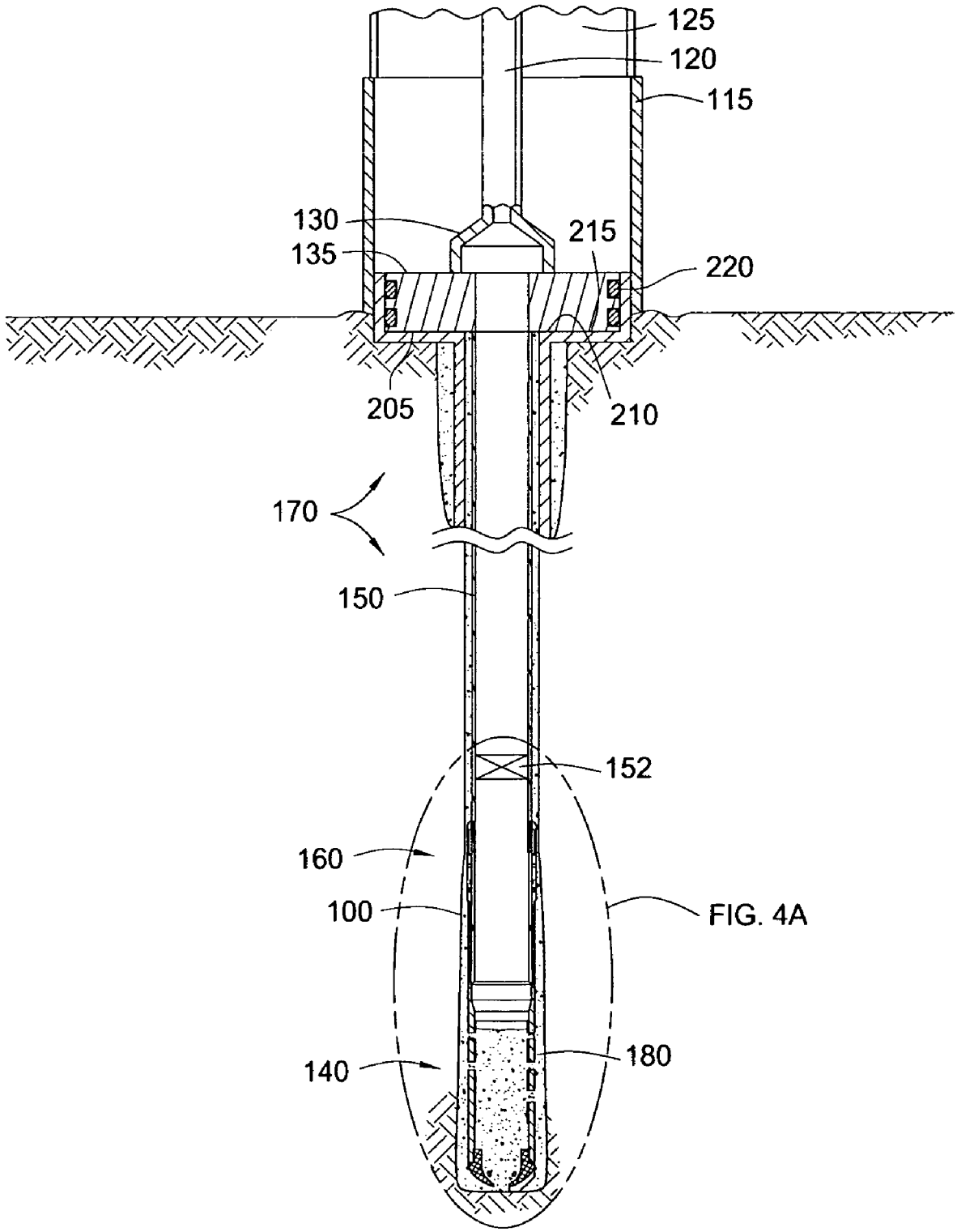
FIG. 4 is a cross-sectional view illustrating the casing assembly after the casing assembly has been cemented into the wellbore.
Figure 4A:
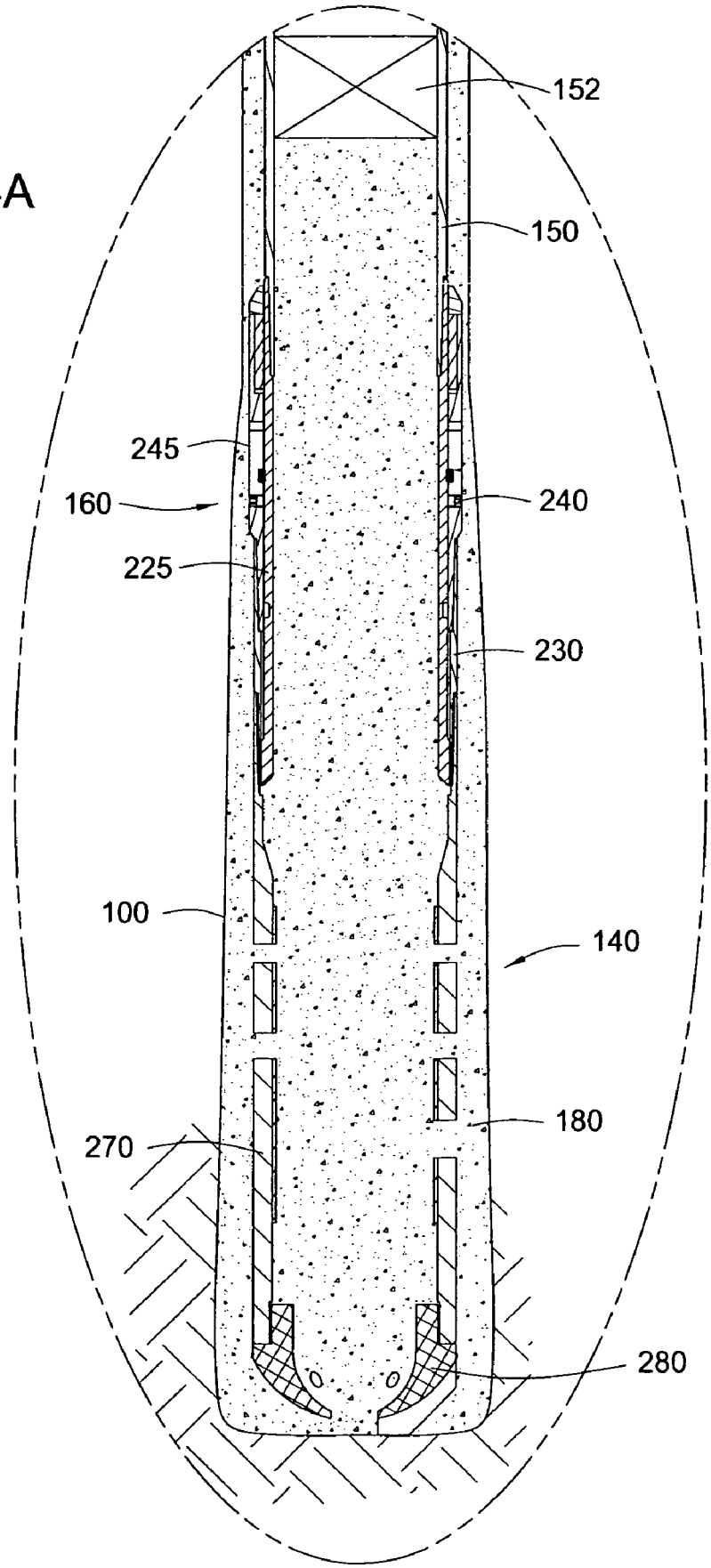
FIG. 4A is an enlarged view of the retractable shoe joint and the guide shoe.

FIG. 4 is a cross-sectional view illustrating the casing assembly 170 after the casing assembly 170 has been cemented into the wellbore 100. FIG. 4A is an enlarged view of the retractable shoe joint 160 and the guide shoe 140. Once the casing hanger 135 has seated in the casinghead 205, cement 180 is pumped through the casing 150 to the guide shoe 140. The cement 180 may or may not be pumped behind circulation fluid, i.e. drilling mud. The cement exits the guide shoe 140 filling the well bore 100 in the region surrounding the guide shoe 140. Circulation fluid is then pumped through the casing 150 to force the cement out of the guide shoe 140. The casing hanger 135 is then actuated (i.e., by rotation of the casing assembly 170) to activate the metal-to-metal seal. Alternatively, for land based wellbores, the cementing step(s) are performed before landing the casing hanger and the casing hanger may not require an additional actuation step.

Assuming that the main port 286 through the nose 280 is plugged, pressure will increase, thereby bursting the burst tube 275*c* covering the circulation ports 285*c*. Depending on the diameter D2, the number of circulation ports 285*c*, and the injection rate of cement, burst tubes 285*a,b* may be ruptured as well. Depending on formation characteristics, circulation ports 285*c* may also be plugged leading to the rupture of burst tubes 275*a,b*. Once the desired amount of cement 180 has been discharged into the well bore 100, the cement is then allowed to harden thereby bonding the casing assembly 170 to the subsea formation surrounding the bottom of the well bore 100. Cement will also fill the areas between the vanes 290*a,b* of the guide shoe 140 and the vanes 248 of the retractable joint 160, thereby rotationally coupling the guide shoe 140 and the retractable joint 160 to the wellbore 100. In the event that the cement 180 does not adequately fill the areas between the vanes 290*a,b* of the guide shoe 140 and the vanes 248 of the retractable joint 160 to provide rotational coupling to the wellbore 100, the slips 255 will still provide rotational coupling between the retractable joint 160 (and the guide shoe 140) and the casing 150.

Figure 5:
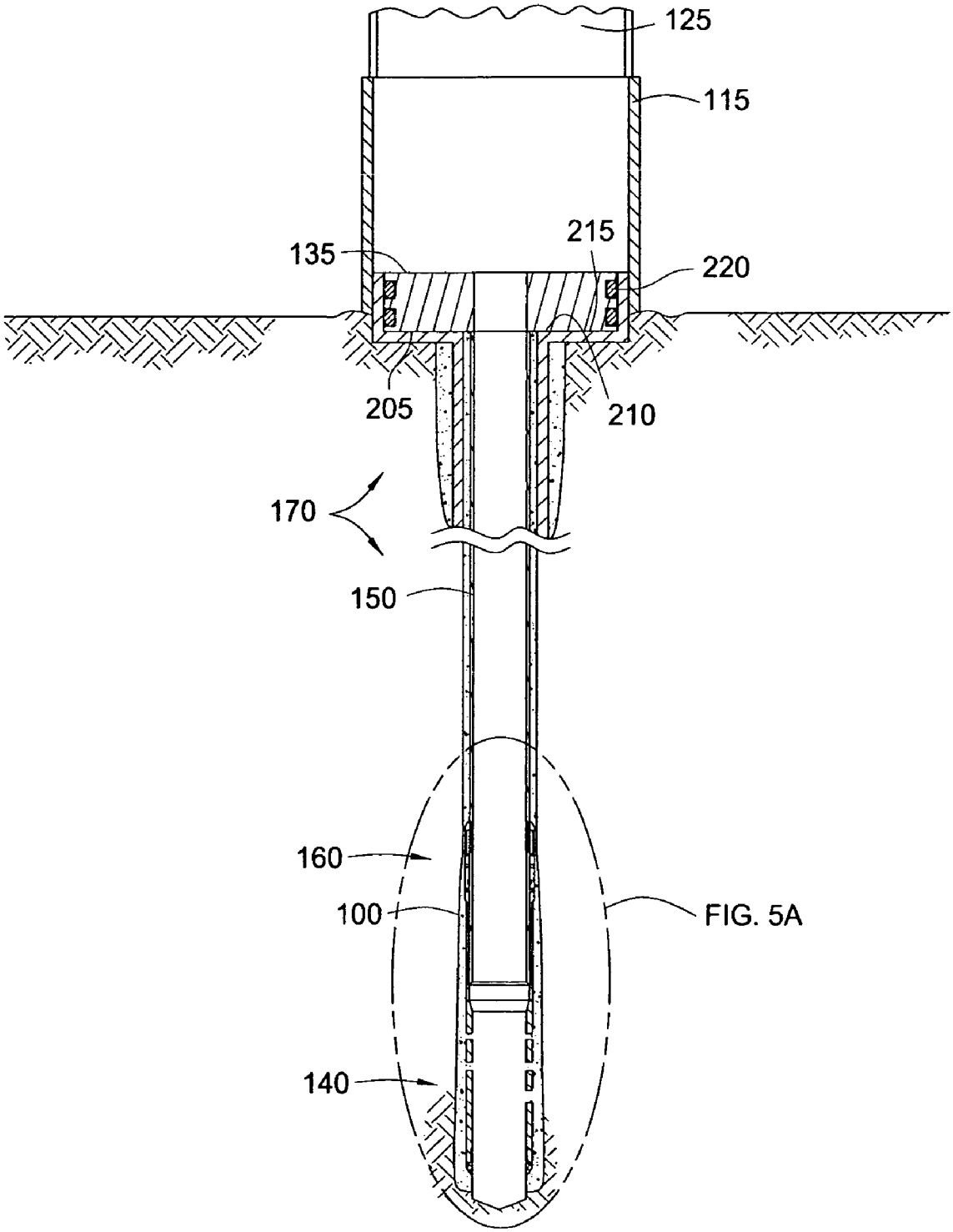
Figure 5A:
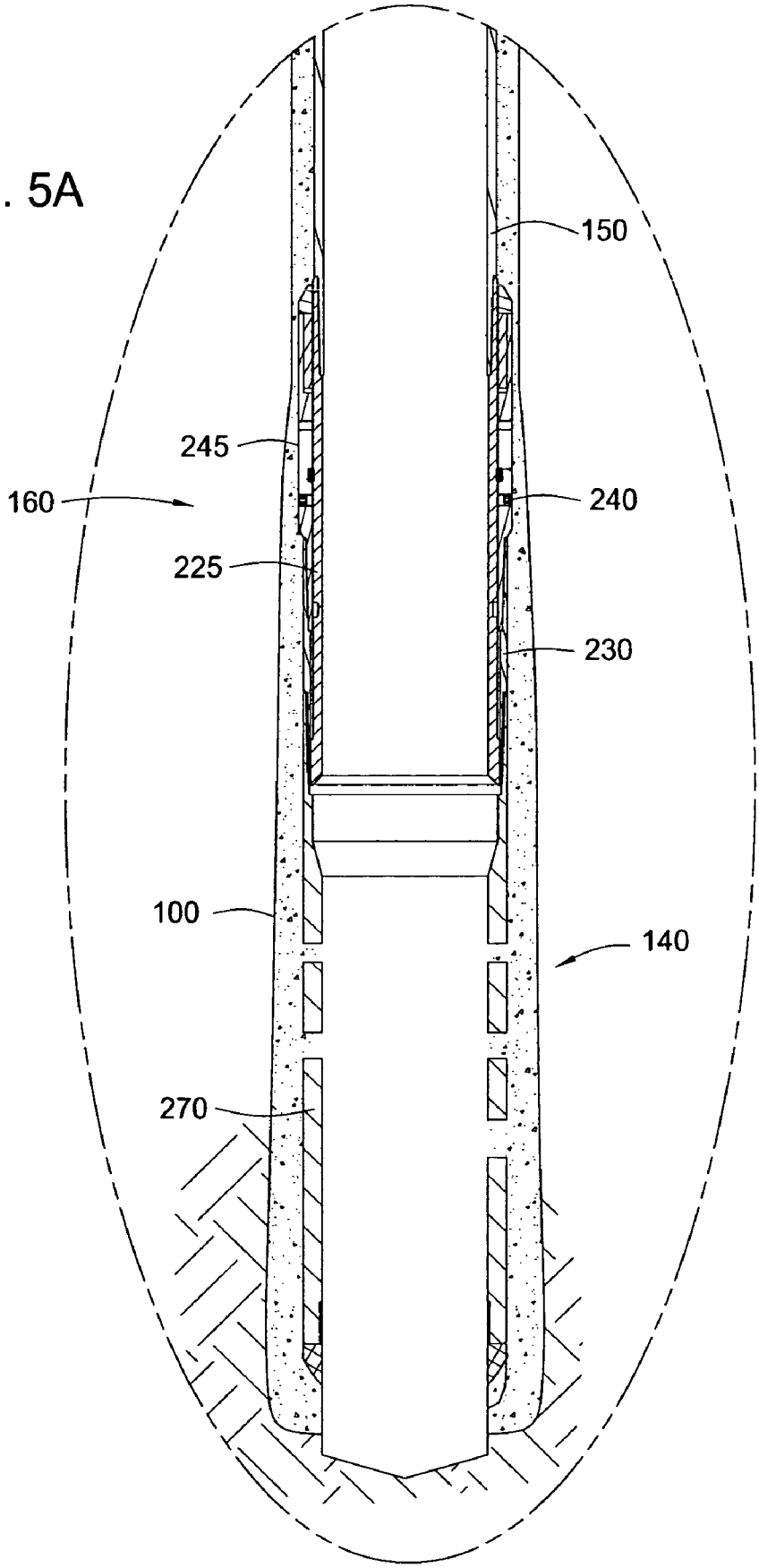
FIG. 5A is an enlarged view of the retractable shoe joint and the guide shoe.

FIG. 5 is a cross-sectional view illustrating the casing assembly 170 after the guide shoe 140 has been drilled through. FIG. 5A is an enlarged view of the retractable shoe joint 160 and the guide shoe 140. After the cement 180 has hardened and the casing assembly 170 bonded in place, a drilling tool (not shown) is then lowered through the casing 150 to the float or landing collar 152. The drilling tool is used to drill through the float or landing collar 152, through any cement left inside the retractable joint 160 and the guide shoe 140, and through the PDC drillable portion of the guide shoe 140. After drilling through the guide shoe 140, the drilling tool then proceeds to drill the next section of the well bore 100 which is typically smaller in diameter than the previously drilled section.

FIGS. 6A-6D are cross sectional views of retractable joints 660*a*-*d*, according to alternative embodiments of the present invention. FIG. 6E is a sectional view taken along line 6E-6E of FIG. 6D.

Figure 6A:
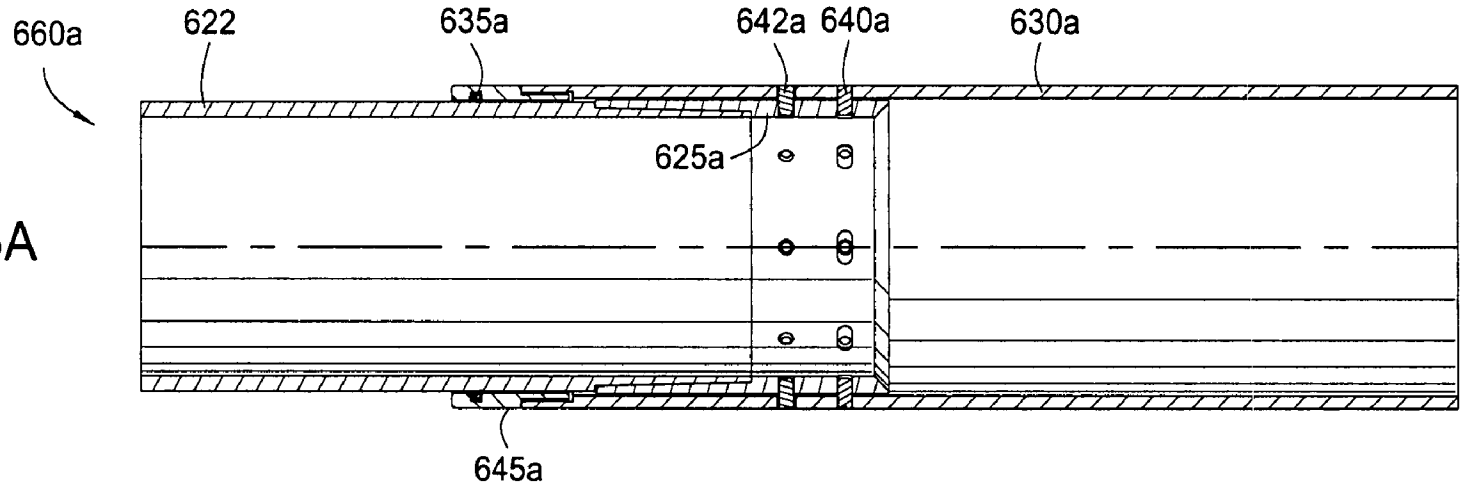
FIGS. 6A-6D are cross sectional views of retractable joints, according to alternative embodiments of the present invention.

Referring to FIG. 6A, the retractable joint 660*a* includes a tubular crossover 622, a tubular shear coupling 625*a*, outer casing 630*a*, a stop ring 645*a*, one or more shear members 640*a*, one or more seals 635*a*, and one or more temporary retaining members 642*a*. The shear coupling 625*a* is coupled to a lower end of the crossover 622 by a threaded connection. The stop ring 645*a* is coupled to the outer casing 630*a* by a threaded connection. The seal 635*a* is disposed in a circumferential groove formed in an inner surface of the stop ring 645*a*. The outer casing 630*a* is secured to the shear coupling 625*a* by the shear members 640*a*. The outer diameter of the shear coupling 625*a* is slightly greater than the outer diameter of the crossover 622 to form a stop shoulder. The stop shoulder will mate with a bottom tip of the stop ring 645*a* to prevent the retractable joint 660*a* from separating after the shear members 640*a* have been broken in case the retractable joint 660*a* must be removed from the wellbore 100 or in case the shear screws 240 fail prematurely, i.e., if an obstruction is encountered in the wellbore at a location where the retraction length of the retractable joint 160 is not sufficient to seat the casing hanger 135 in the casinghead 205. The seal 635*a* is disposed in a radial groove formed in an inner surface of the stop ring 645*a*. The stop ring 645*a* is configured to receive the crossover 622 therein. The outer casing 630*a* is configured to receive the shear coupling 625*a* and the crossover 622 therein. The outer casing 630*a* and crossover 622 are constructed of a predetermined length to allow the casing hanger 135 to seat properly in the casinghead 205.

Figure 6B:
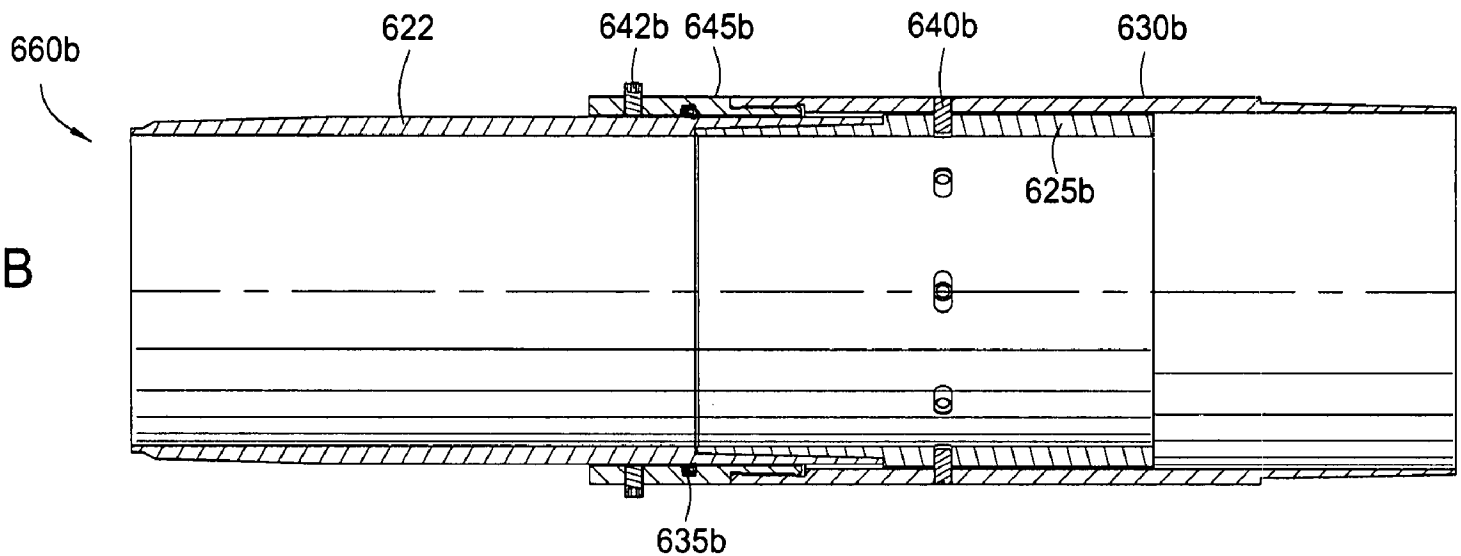

Referring to FIG. 6B, the retractable joint 660*b* includes the crossover 622, a tubular shear coupling 625*b*, an outer casing 630*b*, a stop ring 645*b*, one or more shear members 640*b*, one or more seals 635*b*, and one or more temporary retaining members 642*b*. This embodiment is similar to that of FIG. 6A except that the temporary retaining members 642*b* are set screws and they are located on an opposite side of the seal 635*b*, thereby eliminating any leak paths due to the temporary retaining members 642*b*.

Figure 6C:
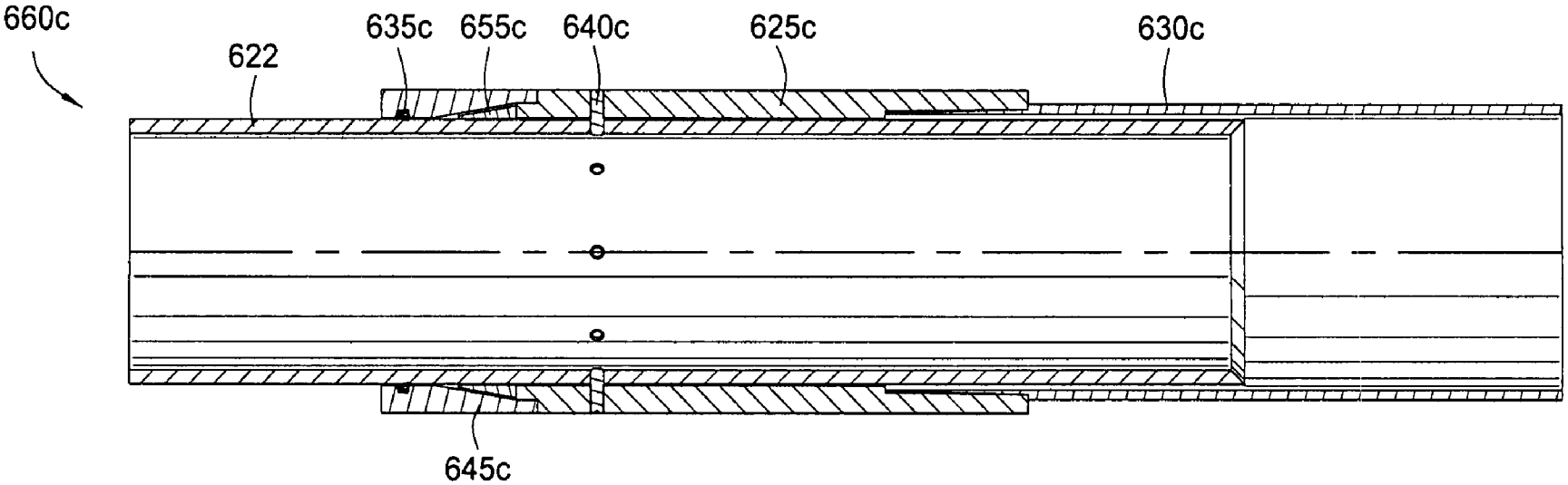

Referring to FIG. 6C, the retractable joint 660*c* includes the crossover 622, a tubular shear coupling 625*c*, outer casing 630*c*, a stop ring 645*c*, one or more shear members 640*c*, one or more seals 635*c*, and a plurality of axial gripping members, such as axial slips 655*c*. The stop ring 645*c* is coupled to an upper end of the shear coupling 625*c* by a threaded connection. The shear coupling 625*c* is coupled to an upper end of the outer casing 630*c* by a threaded connection. The seal 635*c* is disposed in a circumferential groove formed in an inner surface of the stop ring 645*c*. The shear coupling 625*c* is secured to the crossover 622 by the shear members 640*c*. The outer casing 630*c* and the crossover 622 are constructed of a predetermined length to allow the casing hanger 135 to seat properly in the casinghead 205.

Formed on an inner surface of the stop ring 645*c* is an annular groove having an inclined surface. The axial slips 655*c* are disposed in the annular groove of the stop ring 645 and each have an inclined outer surface formed thereon which mates with the inclined inner surface of the stop ring 645*c*, thereby creating a wedge action when the axial slips 655*c* are actuated. The axial slips 655 have teeth (not shown in visible scale) formed on an inner surface thereof. The slip-groove coupling will allow the stop ring 645*c* to move upward relative to the casing 150 but will restrain axial movement in the opposite direction. After the shear members 640 are broken, the slip-groove coupling will provide one-directional axial coupling to prevent the retractable joint 660*c* from separating after the shear members 640*c* have been broken in case the retractable joint 660*c* must be removed from the wellbore 100 or in case the shear members fail prematurely, i.e., if an obstruction is encountered in the wellbore at a location where the retraction length of the retractable joint 160 is not sufficient to seat the casing hanger 135 in the casinghead 205.

Figure 6D:
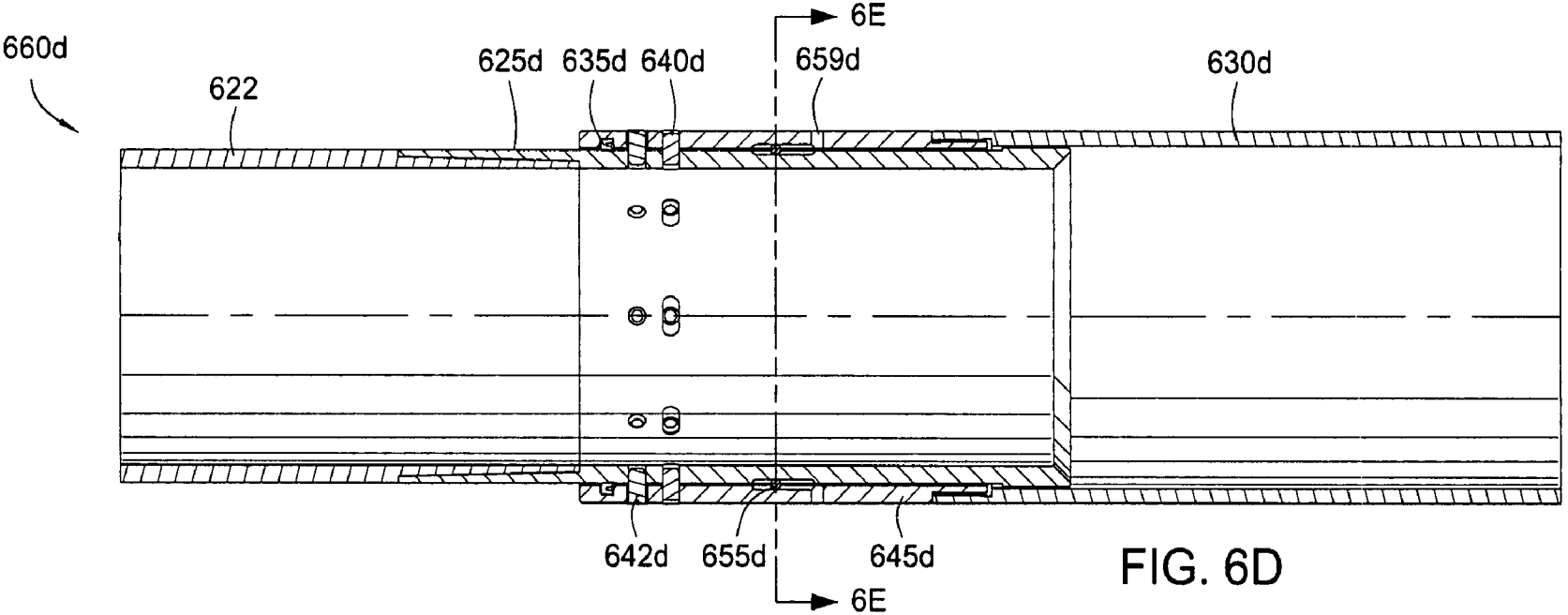
Figure 6E:
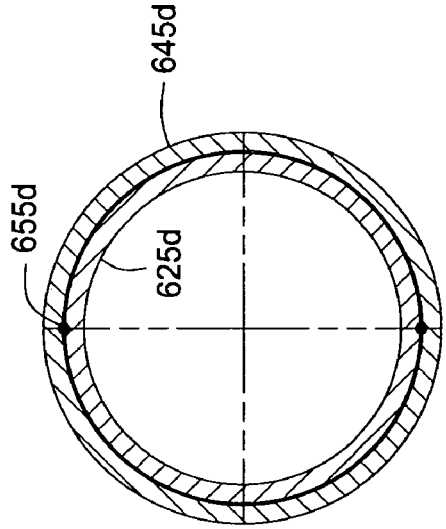
FIG. 6E is a sectional view taken along line 6E-6E of FIG. 6D.

Referring to FIG. 6D, the retractable joint 660*d* includes the crossover 622, a tubular shear coupling 625*d*, outer casing 630*d*, a stop ring 645*d*, one or more shear members 640*d*, one or more seals 635*d*, one or more temporary torque members 642*d*, and one or more anti-rotation members, such as lugs or balls 655*d*. The shear coupling 625*d* is coupled to a lower end of the crossover 622 by a threaded connection. The stop ring 645*d* is coupled to an upper end of the outer casing 630 by a threaded connection. The outer diameter of the shear coupling 625*d* tapers outward slightly to form a stop shoulder. The stop shoulder will mate with a bottom tip of the stop ring 645*d* to prevent the retractable joint 660*d* from separating after the shear members 640*d* have been broken in case the retractable joint 660*d* must be removed from the wellbore 100 or in case the shear members fail prematurely, i.e., if an obstruction is encountered in the wellbore at a location where the retraction length of the retractable joint 160 is not sufficient to seat the casing hanger 135 in the casinghead 205. The seal 635*d* is disposed in a radial groove formed in an inner surface of the stop ring 645*d*. The stop ring 645*d* is secured to the shear coupling 625*d* by the shear members 640*d*. The outer casing 630*d* and the crossover 622 are constructed of a predetermined length to allow the casing hanger 135 to seat properly in the casinghead 205.

The stop ring 645*d* has one or more longitudinal grooves formed on an inner surface thereof and the shear coupling 625*d* has one or more corresponding longitudinal grooves formed on an outer surface thereof. An access hole 659*d* is disposed through the stop ring 645*d* for each pair of grooves and a ball 655*d* is disposed in each pair of grooves. The ball-groove coupling allows the shear coupling 625*d* to move longitudinally relative to the stop ring 645*d* while restraining rotational movement therebetween. When the retractable coupling is actuated and the stop ring 645*d* moves upward relative to the casing 150, each ball 655*d* will become aligned with the access hole 659*d*. Further axial movement will eject each ball 655*d* through a respective access hole 659*d*, thereby allowing continued actuation of the retractable joint 660*d*.

Figure 7A:
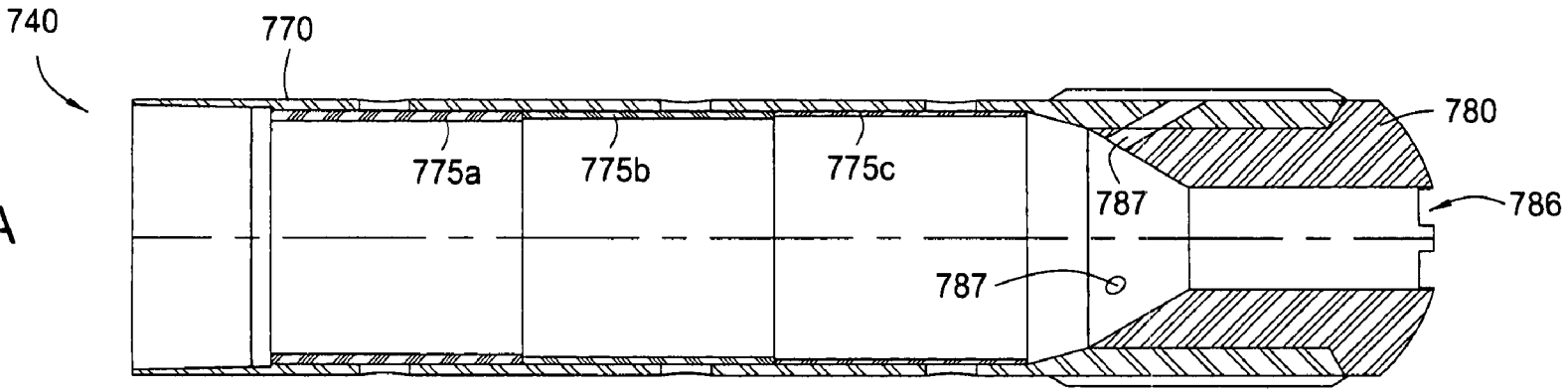
FIG. 7A is a cross sectional view of a guide shoe, according to an alternative embodiment of the present invention.
Figure 7B:
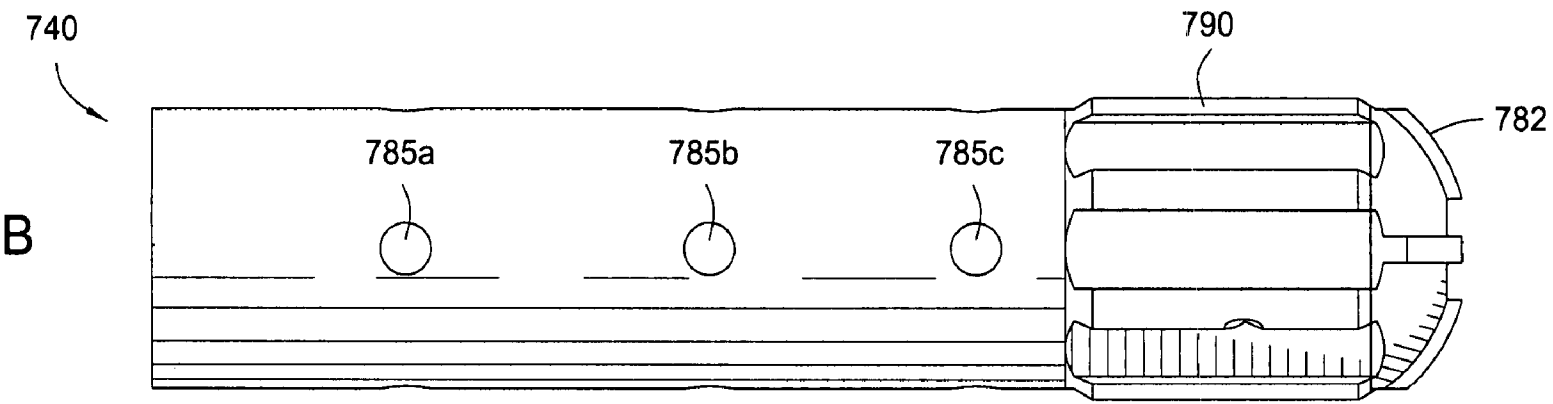
FIG. 7B is an isometric view of the guide shoe.

FIG. 7A is a cross sectional view of a guide shoe 740, according to an alternative embodiment of the present invention. FIG. 7B is an isometric view of the guide shoe 740. The guide shoe 740 includes a body 770 and a nose 780. The body 770 is a tubular member and has a main axial bore therethrough. Formed on the outside of the guide shoe 740 are one or more vanes 790. The vanes 790 serve as reaming members during run in of the casing assembly 170, as centralizers, and as anti-rotation members after cementing and during drill through of the nose portion 780. Cement will fill the areas between the vanes 790, thereby rotationally coupling the body 770 to the wellbore 100.

Formed integrally at a lower end of the body 770 is the nose 780. Alternatively, the nose 780 may be coupled to the body by a threaded connection or molded in place with a series of grooves or wickers formed into the body. The nose 780 is a convex member made from a PDC drillable material, usually a non-ferrous material, such as aluminum (preferred), cement, brass, or a composite material. The nose 780 has an axial bore therethrough which is in communication with a main port 786 through a bottom tip of the nose 780. Disposed through a side of the nose are one or more jet ports 787. Disposed on an outer surface of the nose 780 are one or more blades 782. The blades 782 will serve to remove any obstacles encountered by the guide shoe 740 during run in of the casing assembly 170.

Disposed through a wall of the body 770 are one or more sets 785*a-c* of one or more circulation ports having equal or substantially equal diameters. Lining an inner side of the body 770 and covering each set of circulation ports 785*a-c* are burst tubes 775*a-c*, respectively. The burst tubes are made from a PDC drillable material, such as a non-ferrous metal or a polymer. The thickness of the burst tube 775*a* is greater than the thickness of burst tube 775*b* which is greater than the thickness of burst tube 775*c*. The burst pressure of each of the burst tubes 775*a-c* will be proportional to the respective thickness (including higher order relations, i.e. burst pressure proportional to thickness squared). The differing thicknesses will produce a similar effect to the differing circulation port diameters D2-D4 of the guide shoe 140.

In alternate embodiments, features of any of the retractable joints 160, 660*a-d* may be combined to construct the retractable joint. Similarly, any features of the guide shoes 140,740 may be combined to construct the guide shoe.

In alternate embodiments, a second (or more) 160,660*a-d* retractable joint may be disposed in the casing assembly 170 to increase the retraction length of the casing assembly 170.

The retractable joints 160,660*a-d* are advantageous over previous system(s) in that pressure and/or circulation is not required to activate them. Further, landing the guide shoe 140 at the bottom of the wellbore prevents pressure surge and damage to the formation and ensures that the washed out section of hole is cemented.

Individual components of the retractable joints 160,660*a-d* may be manufactured at a remote location and shipped to a well-site, such as the floating platform 105 for assembly or the retractable joints 160,660*a-d* may be assembled (with the temporary retaining members instead of the shear members) prior to shipment in a retracted position and shipped to the floating platform 105. The retractable joint 160 may be assembled using the same machinery used to make up the existing tubulars prior to running into the wellbore 100 as well as ordinary hand tools used in maintaining and assembling oilfield service tools. The retractable joints 160,660*a-d* may also be shipped as a unit ready to be run into the wellbore 100 once bucked onto the existing tubular. Shipping the retractable joints 160,660*a-d* to the floating platform 105 in pieces or partially assembled may alleviate shipping length restrictions.

In one embodiment, the manufacturing and assembly process may proceed at a manufacturing site as follows. The outer sleeve 245, the outer casing 230, the inner sleeve 225, and the crossover 222 are manufactured (some manufacturing steps may be performed at other manufacturing sites). The sealing member 235 is installed into the outer sleeve 245. The outer sleeve 245 is then slid over the inner sleeve. The slips 255 and springs 257 are inserted and the cap 247 is attached. The crossover 222 is attached to the inner sleeve 225. The outer casing 230 is attached to the outer sleeve 245. The crossover 222 is slid into the outer casing 230. The outer sleeve 245 is attached to the crossover 222 with the temporary retainers. Finally, the retractable joint 160 is delivered to the well-site. At the well-site, the crew may simply remove the temporary retainers, extend the retractable joint 160, insert the shear screws 240, and attach the guide shoe 140. The retractable joint 160 is then ready to be assembled with the casing 150 for insertion into the wellbore 100. Alternatively, the guide shoe 140 may be assembled and attached to the retractable joint 160 at the manufacturing site and delivered with the retractable joint 160 already attached. Alternatively, the retractable joint 160 may be assembled except for the crossover 222 and the outer casing 230 which may be attached at the well-site.

While the foregoing is directed to embodiments of the present invention, other and further embodiments of the invention may be devised without departing from the basic scope thereof, and the scope thereof is determined by the claims that follow.

The invention claimed is:

1. A method of lining a pre-drilled wellbore, comprising:
providing a casing assembly, the casing assembly comprising:
a string of casing;
a retractable joint comprising an inner tubular and an outer tubular; and
a hanger;
running the casing assembly into the pre-drilled wellbore; and
actuating the retractable joint, thereby reducing the length of the casing assembly through movement between the inner and outer tubulars and landing the hanger into a casinghead.

2. The method of claim 1, wherein the retractable joint comprises a shearable member coupling the inner and outer tubulars.

3. The method of claim 2, wherein the act of actuating the retractable joint comprises setting at least some of the weight of the casing on the retractable joint, thereby breaking the shearable member.

4. The method of claim 1, further comprising injecting cement through the casing assembly and into an annulus between the casing assembly and the wellbore.

5. The method of claim 1, wherein the retractable joint is disposed at an end of the casing string distal from a surface of the wellbore.

6. The method of claim 1, wherein the casing assembly further comprises a second retractable joint.

7. The method of claim 1, wherein the retractable joint further comprises an anti-rotation member coupling the inner and outer tubulars.

8. The method of claim 7, wherein the anti-rotation member comprises a slip.

9. The method of claim 7, wherein the anti-rotation member comprises a ball.

10. The method of claim 7, wherein the anti-rotation member comprises a shearable member.

11. The method of claim 7, wherein the anti-rotation member comprises a spline.

12. The method of claim 1, wherein the outer tubular has a vane disposed on an outer surface thereof.

13. The method of claim 1, wherein the length of the casing assembly is greater than a depth of the wellbore.

14. The method of claim 1, wherein the casing assembly further comprises a guide shoe and the act of running comprises running the casing assembly into the pre-drilled wellbore until the guide shoe rests on the bottom of the wellbore.

15. The method of claim 1, wherein the casing assembly further comprises a guide shoe, the guide shoe comprising a body having an axial bore therethrough and at least one port through a wall thereof;

a liner covering the port, the liner configured to rupture at a predetermined pressure; and a nose disposed on the body, made from a drillable material, and having a bore therethrough.

16. The method of claim 15, wherein the nose has a blade disposed on an outer surface thereof.

17. The method of claim 15, wherein the body has a vane disposed on an outer surface thereof.

18. The method of claim 15, wherein the liner is made from a drillable material.

19. The method of claim 15, wherein the body further comprises a second port through the wall thereof, the second port is covered by the liner or a second liner having a thickness substantially equal to the thickness of the liner, the first port is axially disposed proximate to the nose and the second port is axially disposed distal from the nose, and the diameter of the second port is less than the diameter of the first port.

20. The method of claim 15, wherein the body further comprises a second port through the wall thereof, the second port is covered by a second liner having a thickness greater than the thickness of the liner, the first port is axially disposed proximate to the nose and the second port is axially disposed distal from the nose, and the diameter of the second port substantially equal to the diameter of the first port.

21. The method of claim 15, further comprising injecting circulation fluid through the casing assembly, thereby increasing pressure inside the guide shoe and rupturing the liner.

22. The method of claim 21, further comprising drilling through the nose of the guide shoe.

23. The method of claim 1, wherein the retractable joint is configured so that the inner tubular will slide into the outer tubular when the retractable joint is actuated.

24. The method of claim 1, wherein the retractable joint is configured so that the outer tubular will slide over the inner tubular when the retractable joint is actuated and the inner tubular is made from a drillable material.

25. A method of drilling a wellbore, comprising:

rotating a drill bit or drill shoe of a casing assembly, the casing assembly comprising:

a string of casing;

a retractable joint comprising an inner tubular and an outer tubular; and the drill bit or drill shoe coupled to a lower one of the inner and outer tubulars;

drilling the wellbore with the casing assembly; and actuating the retractable joint, thereby reducing the length of the casing assembly through movement between the inner and outer tubulars.

26. The method of claim 25, wherein the retractable joint comprises a shearable member coupling the inner and outer tubulars.

27. The method of claim 26, wherein the act of actuating the retractable joint comprises setting at least some of the weight of the casing on the retractable joint, thereby breaking the shearable member.

28. The method of claim 25, wherein the casing assembly further comprises a hanger and the hanger is landed into a casinghead from actuating the retractable joint.

29. The method of claim 25, further comprising injecting cement through the casing assembly and into an annulus between the casing assembly and the wellbore.

30. The method of claim 25, wherein the retractable joint further comprises an anti-rotation member coupling the inner and outer tubulars after and during actuation of the retractable joint.

31. The method of claim 30, wherein the anti-rotation member comprises a slip.

32. The method of claim 30, wherein the anti-rotation member comprises a ball.

33. The method of claim 30, wherein the anti-rotation member comprises a shearable member.

34. The method of claim 30, wherein the anti-rotation member comprises a spline.

35. The method of claim 25, wherein:

the casing assembly comprises the drill shoe, and the drill shoe comprises:

an outer drilling section made from steel, and an inner drilling section made from a drillable material.

36. The method of claim 35, further comprising:

displacing the outer section; and drilling through the inner section.

37. The method of claim 25, wherein the retractable joint is located proximate to the drill bit or drill shoe.

38. The method of claim 25, wherein the retractable joint is located distally from the drill bit or drill shoe.

39. A method of lining a pre-drilled wellbore, comprising:

providing a casing assembly, the casing assembly comprising:

a string of casing; and a retractable joint comprising an inner tubular, an outer tubular, and an anti-rotation member coupling the inner and outer tubulars, wherein the anti-rotation member comprises a ball;

running the casing assembly into the pre-drilled wellbore; and actuating the retractable joint, thereby reducing the length of the casing assembly through movement between the inner and outer tubulars.

40. A method of lining a pre-drilled wellbore, comprising:

providing a casing assembly, the casing assembly comprising:

a string of casing; and a retractable joint comprising an inner tubular and an outer tubular, wherein the outer tubular has a vane disposed on an outer surface thereof;

running the casing assembly into the pre-drilled wellbore; and actuating the retractable joint, thereby reducing the length of the casing assembly through movement between the inner and outer tubulars.

41. A method of lining a pre-drilled wellbore, comprising:

providing a casing assembly, the casing assembly comprising:

a string of casing;

a retractable joint comprising an inner tubular and an outer tubular; and a guide shoe, comprising:

a body having an axial bore therethrough and at least one port through a wall thereof;

a liner covering the port, the liner configured to rupture at a predetermined pressure; and a nose disposed on the body, made from a drillable material, and having a bore therethrough;

running the casing assembly into the pre-drilled wellbore; and actuating the retractable joint, thereby reducing the length of the casing assembly through movement between the inner and outer tubulars.

42. The method of claim 41, wherein the nose has a blade disposed on an outer surface thereof.

43. The method of claim 41, wherein the body has a vane disposed on an outer surface thereof.

44. The method of claim 41, wherein the liner is made from a drillable material.

45. The method of claim 41, wherein the body further comprises a second port through the wall thereof, the second port is covered by the liner or a second liner having a thickness substantially equal to the thickness of the liner, the first port is axially disposed proximate to the nose and the second port is axially disposed distal from the nose, and the diameter of the second port is less than the diameter of the first port.

46. The method of claim 41, wherein the body further comprises a second port through the wall thereof, the second port is covered by a second liner having a thickness greater than the thickness of the liner, the first port is axially disposed proximate to the nose and the second port is axially disposed distal from the nose, and the diameter of the second port substantially equal to the diameter of the first port.

47. The method of claim 41, further comprising injecting circulation fluid through the casing assembly, thereby increasing pressure inside the guide shoe and rupturing the liner.

48. The method of claim 41, further comprising drilling through the nose of the guide shoe.

49. The method of claim 48, wherein:

the casing assembly further comprises a guide shoe, and the method further comprises:

rotating the casing assembly while running the casing assembly into the wellbore; and injecting cement through the casing assembly and into an annulus between the casing assembly and the wellbore.

50. A method of lining a pre-drilled wellbore, comprising:

running a casing assembly into the pre-drilled wellbore, the casing assembly comprising:

a string of casing; and a retractable joint comprising an inner tubular, an outer tubular, and an anti-rotation member and movable between an extended and retracted position; and actuating the retractable joint from the extended position to the retracted position, thereby reducing the length of the casing assembly through movement between the inner and outer tubulars, wherein the anti-rotation member rotationally couples the tubulars at and between the positions.

51. A method of lining a pre-drilled wellbore, comprising:

running the casing assembly into the pre-drilled wellbore while rotating the casing assembly and injecting drilling fluid through the casing assembly, the casing assembly comprising:

a string of casing;

a retractable joint comprising an inner tubular and an outer tubular; and a guide shoe; and actuating the retractable joint, thereby reducing the length of the casing assembly through movement between the inner and outer tubulars.

52. A method of lining a pre-drilled wellbore, comprising:

running the casing assembly into the pre-drilled wellbore, the casing assembly comprising:

a string of casing; and a retractable joint comprising an inner tubular and an outer tubular;

actuating the retractable joint, thereby reducing the length of the casing assembly through movement between the inner and outer tubulars;

after actuation of the retractable joint, injecting cement through the casing assembly and into an annulus between the casing assembly and the wellbore.

53. A method of lining a pre-drilled wellbore, comprising:

running a casing assembly into the pre-drilled wellbore, the casing assembly comprising:

a string of casing;

a retractable joint comprising an inner tubular and an outer tubular; and a guide shoe, comprising:

a body having an axial bore therethrough and at least one port through a wall thereof, the port being closed by a frangible member;

the frangible member operable to rupture at a predetermined pressure; and actuating the retractable joint, thereby reducing the length of the casing assembly through movement between the inner and outer tubulars;

injecting cement into the casing assembly and into an annulus between the casing assembly and the wellbore; and injecting circulation fluid through the casing assembly, thereby increasing pressure inside the guide shoe and rupturing the frangible member.

54. The method of claim 53, further comprising rotating the casing assembly while running the casing assembly into the wellbore.

55. The method of claim 53, wherein the guide shoe further comprises a nose disposed on the body, made from a drillable material, and having a bore therethrough.

56. The method of claim 55, further comprising drilling through the nose of the guide shoe.

57. The method of claim 55, wherein the nose has a blade disposed on an outer surface thereof.

58. The method of claim 53, wherein the body has a vane disposed on an outer surface thereof.

59. A method of lining a wellbore, comprising:

running the casing assembly into the wellbore while rotating the casing assembly and injecting drilling fluid through the casing assembly, the casing assembly comprising:

a string of casing;

two retractable joints, each joint comprising an inner tubular and an outer tubular; and a drill bit or shoe; and actuating one or more of the retractable joints, thereby reducing the length of the casing assembly through movement between the inner and outer tubulars.

60. A method of lining a pre-drilled wellbore, comprising:

running a casing assembly into the pre-drilled wellbore, the casing assembly comprising:

a string of casing;

a retractable joint comprising an inner tubular and an outer tubular; and a guide shoe, comprising:

a body having an axial bore therethrough and at least one port through a wall thereof, the port being closed by a frangible member;

the frangible member operable to rupture at a predetermined pressure; and a nose disposed on the body, made from a drillable material, having a bore therethrough and a blade disposed on an outer surface thereof; and actuating the retractable joint, thereby reducing the length of the casing assembly through movement between the inner and outer tubulars.

61. A method of lining a pre-drilled wellbore, comprising:

running a casing assembly into the pre-drilled wellbore, the casing assembly comprising:

a string of casing;

a retractable joint comprising an inner tubular and an outer tubular; and a guide shoe, comprising:

a body having an axial bore therethrough, at least one port through a wall thereof, the port being closed by a frangible member, and a vane disposed on an outer surface thereof;

the frangible member operable to rupture at a predetermined pressure; and actuating the retractable joint, thereby reducing the length of the casing assembly through movement between the inner and outer tubulars.

* * * * *